US011226078B2

(12) United States Patent
Nishimura et al.

(10) Patent No.: US 11,226,078 B2
(45) Date of Patent: Jan. 18, 2022

(54) VEHICULAR LAMP FITTING

(71) Applicant: STANLEY ELECTRIC CO., LTD., Tokyo (JP)

(72) Inventors: Shota Nishimura, Tokyo (JP); Kazuma Kamioka, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/390,932

(22) Filed: Apr. 22, 2019

(65) Prior Publication Data

US 2019/0323672 A1 Oct. 24, 2019

(30) Foreign Application Priority Data

Apr. 23, 2018 (JP) ..... JP2018-082204
Apr. 24, 2018 (JP) ..... JP2018-082996

(51) Int. Cl.

| | |
|---|---|
| ***F21S 41/26*** | (2018.01) |
| ***F21W 102/16*** | (2018.01) |
| ***F21S 41/32*** | (2018.01) |
| ***F21S 41/24*** | (2018.01) |
| ***F21S 41/143*** | (2018.01) |

(52) U.S. Cl.
CPC ..... *F21S 41/26* (2018.01); *F21S 41/24* (2018.01); *F21S 41/322* (2018.01); *F21S 41/143* (2018.01); *F21W 2102/16* (2018.01)

(58) Field of Classification Search
CPC ..... F21S 41/26; F21S 41/285; F21S 41/24; F21S 41/322; F21S 41/143; F21W 2102/16; F21W 2102/155
See application file for complete search history.

(56) References Cited

U.S. PATENT DOCUMENTS 8,752,991 B2 * 6/2014 Owada ..... F21S 41/151 362/522
10,151,437 B2 * 12/2018 Gromfeld ..... F21S 41/143
(Continued)

FOREIGN PATENT DOCUMENTS

DE 102016109132 A1 * 11/2017 ..... F21S 41/322
EP 3 150 905 A1 4/2017
(Continued)

OTHER PUBLICATIONS

The extended European Search Report for the related European Patent Application No. 19170511.0 dated Sep. 19, 2019.

*Primary Examiner* — Erin Kryukova
(74) *Attorney, Agent, or Firm* — Kenealy Vaidya LLP

(57) ABSTRACT

A vehicular lamp fitting comprising a front lens body, a rear lens unit, and a light source that emits light, which passes through the rear lens unit and the front lens body, to form a low beam light distribution pattern, wherein the rear lens unit is a lens unit configured to condense, in a first direction, the light coming from the light source, and includes a first entry surface, and a first exit surface, the front lens body is a lens unit configured to condense, in a second direction, the light coming from the rear lens unit, and includes a second entry surface, and a second exit surface, the front lens body is disposed in an attitude that is inclined, and a curvature of the first exit surface in the longitudinal section or a curvature of the second entry surface in the longitudinal section is different in each longitudinal section.

5 Claims, 26 Drawing Sheets

(56) References Cited

U.S. PATENT DOCUMENTS

| | | | | |
|---|---|---|---|---|
| 10,473,286 | B2 * | 11/2019 | Nishimura | F21S 41/43 |
| 10,753,564 | B2 * | 8/2020 | Sakamoto | F21S 41/663 |
| 2004/0156209 | A1 * | 8/2004 | Ishida | F21S 41/143<br>362/516 |
| 2008/0151567 | A1 | 6/2008 | Albou | |
| 2012/0140508 | A1 * | 6/2012 | Owada | F21S 41/151<br>362/538 |
| 2014/0362596 | A1 * | 12/2014 | Nakaya | G02B 19/0028<br>362/511 |
| 2017/0030543 | A1 * | 2/2017 | Gromfeld | F21S 41/322 |
| 2017/0211771 | A1 * | 7/2017 | Nishimura | F21S 41/25 |
| 2018/0087732 | A1 | 3/2018 | De Lamberterie et al. | |
| 2019/0017675 | A1 * | 1/2019 | Suwa | F21S 41/26 |
| 2019/0093846 | A1 * | 3/2019 | Gromfeld | F21S 41/322 |
| 2019/0195453 | A1 * | 6/2019 | Sakamoto | F21S 41/322 |

FOREIGN PATENT DOCUMENTS

| | | | | |
|---|---|---|---|---|
| EP | 3 163 155 | A1 | 5/2017 | |
| EP | 3 301 348 | A1 | 4/2018 | |
| WO | 2015/178155 | A1 | 11/2015 | |
| WO | WO-2017185118 | A1 * | 11/2017 | F21S 41/322 |

* cited by examiner

VEHICULAR LAMP FITTING

CROSS-REFERENCE TO RELATED APPLICATIONS

This application is based upon and claims the benefit of priority of the prior Japanese Patent Application No. 2018-082204, filed on Apr. 23, 2018, and the Japanese Patent Application No. 2018-082996, filed on Apr. 24, 2018, the entire contents of which are incorporated herein by reference.

FIELD

The present invention relates to a vehicular lamp fitting, and more particularly to a vehicular lamp fitting which suppresses generation of the relative drop of luminous intensity in a part of a predetermined light distribution pattern (e.g. low beam light distribution pattern) (generation of a blurred state), even if a front lens body is disposed in an attitude that is inclined at a predetermined receding angle.

BACKGROUND

FIG. 15 is a longitudinal sectional view of a conventional vehicular lamp fitting 100. FIG. 16 is a lateral sectional view of the vehicular lamp fitting 100 illustrated in FIG. 15 (portions other than the major optical surface are omitted).

Conventionally a vehicular lamp fitting 100 is known, which includes: a front lens body 101; a rear lens unit 102 disposed behind the front lens body 101; and a light source 103 that is disposed behind the rear lens unit 102, and that emits light, which passes through the rear lens unit 102 and the front lens body 101 in this order, and is irradiated forward, so as to form a predetermined light distribution pattern (e.g. low beam light distribution pattern), as illustrated in FIG. 15 (e.g. see WO 2015/178155 (FIG. 32)). The rear lens unit 102 is a lens unit configured to condense light in a first direction (e.g. direction orthogonal to the paper surface in FIG. 15), and the front lens body 101 is a lens unit configured to condense light in a second direction orthogonal to the first direction (e.g. vertical direction in FIG. 15).

The rear lens unit 102 includes a first entry surface 102*a*, a first exit surface 102*b* disposed on the opposite side of the first entry surface 102*a*, an edge 102*c* disposed between the first entry surface 102*a* and the first exit surface 102*b* (disposed on a focal point F), and a reflection surface 102*d* which extends backward from the edge 102*c*. A curvature of the first exit surface 102*b* in the longitudinal section is the same in each longitudinal section.

The front lens body 101 includes a second entry surface 101*a* and a second exit surface 101*b* disposed on the opposite side of the second entry surface 101*a*.

The front lens body 101 and the rear lens unit 102 are connected by a connecting unit 104. The connecting unit 104 connects an upper part of the front lens body 101 and an upper part of the rear lens unit 102 in a state of forming a space Sa between the front lens body 101 and the rear lens unit 102.

The front lens body 101, the rear lens unit 102 and the connecting unit 104 are integrally molded by injecting such transparent resin as polycarbonate and acrylic into a die.

In concrete terms, the front lens body 101, the rear lens unit 102 and the connecting unit 104 are formed by a die of which extracting direction is the opposite from the connecting unit 104 (see the arrow mark AR in FIG. 15). To smoothly extract the die, the second entry surface 101*a* of the front lens body 101 is formed as a plane.

The second exit surface 101*b* of the front lens body 101, on the other hand, is configured as a semicircular cylindrical surface (cylindrical surface), of which cylindrical axis extends in a first direction (linearly), in order to condense the light coming from the light source 103, which exits through the second exit surface 101*b*, in a second direction orthogonal to the first direction.

In the vehicular lamp fitting 100 having the above mentioned configuration, when the light source 103 is turned ON, the light coming from the light source 103 enters the rear lens unit 102 through the first entry surface 102*a*, is partially shielded by a reflection surface 102*d*, and exits through the first exit surface 102*b*, together with the reflected light coming from the reflection surface 102*d*. At this time, the light coming from the light source 103, which exits through the first exit surface 102*b*, is condensed in the first direction by a function of the first exit surface 102*b*. Then the light coming from the light source 103, which exited through the first exit surface 102*b*, passes through the space Sa between the rear lens unit 102 and the front lens body 101, further enters the front lens body 101 through the second entry surface 101*a*, exits through the second exit surface 101*b*, and is irradiated forward. At this time, the light coming from the light source 103, which exits through the second exit surface 101*b*, is condensed in the second direction by a function of the second exit surface 101*b*. Thereby the predetermined light distribution pattern (the low beam light distribution pattern in this case) is formed.

PRIOR ART

[Patent Document 1] WO 2015/178155

SUMMARY

However, after intensive studies, the present inventors discovered that in the case of the vehicular lamp fitting 100 having the above mentioned configuration, a relative drop of luminous intensity in a part of the predetermined light distribution pattern (the low beam light distribution pattern in this case) is generated (a blurred state is generated) when the front lens body 101 is disposed in an attitude that is included at a receding angle θ1 with respect to a reference axis AX1 extending in the vehicle width direction when viewed from the top, as illustrated in FIG. 16.

With the foregoing in view, it is a first object of the present invention to provide a vehicular lamp fitting which suppresses the generation of a relative drop of the luminous intensity in a part of a predetermined light distribution pattern (e.g. low beam light distribution pattern) (a generation of a blurred instate), even if the front lens body is disposed in an attitude that is inclined at a predetermined receding angle.

FIG. 24 is a longitudinal sectional view of a conventional vehicular lamp fitting 100. FIG. 25 is an example of disposing a plurality of light sources 103*a* to 103*c* in the vicinity of a focal point F of a projection lens constituted of a front lens body 101A and a rear lens unit 102A. FIG. 26 is a front view of the front lens body 101A illustrated in FIG. 25.

Conventionally a vehicular lamp fitting 100 is known, which includes: a front lens body 101; a rear lens unit 102 disposed behind the front lens body 101; and a light source 103 that is disposed behind the rear lens unit 102, and that emits light, which passes through the rear lens unit 102 and the front lens body 101 in this order and is irradiated forward, so as to form a low beam light distribution pattern, as illustrated in FIG. 24 (e.g. see WO 2015/178155 (FIG. 32)). The rear lens unit 102 is a lens unit configured to condense light in a first direction (e.g. direction orthogonal to the paper surface in FIG. 24), and the front lens body 101 is a lens unit configured to condense light in a second direction orthogonal to the first direction (e.g. vertical direction in FIG. 24).

The present inventors studied a forming of an ADB light distribution pattern by disposing a plurality of light sources 103*a* to 103*c* in the horizontal direction (direction orthogonal to the paper surface in FIG. 9), for example, in the vicinity of the focal point F of a projection lens constituted by the front lens body 101A and the rear lens unit 102A, as illustrated in FIG. 25, for example.

In order to enhance the design, the present inventors also studied disposing the front lens body 101A in an attitude that is inclined, with respect to the reference axis AX1 extending in the vehicle width direction, at an upward angle θ2 when viewed from the front, as illustrated in FIG. 26.

As a result of these studies, the present inventors discovered that in the case of disposing the front lens body 101A in an attitude that is inclined by the upward angle θ2, the ADB light distribution pattern is formed in a state of being diagonally deformed (diagonal blur state).

With the foregoing in view, it is a second object of the present invention to provide a vehicular lamp fitting which suppresses the generation of an ADB light distribution pattern in a state of being diagonally deformed (diagonal blur state), even if the front lens body is disposed in an attitude that is inclined at a predetermined upward angle.

In order to achieve the first object described above, an aspect of the present invention provides a vehicular lamp fitting comprising: a front lens body; a rear lens unit disposed behind the front lens body; and a light source that is disposed behind the rear lens unit, and that emits light, which passes through the rear lens unit and the front lens body in this order and is irradiated forward, so as to form a low beam light distribution pattern, wherein the rear lens unit is a lens unit configured to condense, at least in a first direction, the light coming from the light source and passing through the rear lens unit, and includes: a first entry surface through which the light coming from the light source enters the rear lens unit; a first exit surface through which the light coming from the light source, which entered the rear lens unit, exits; and an edge which defines a cut-off line of the low beam light distribution pattern, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is disposed in an attitude that is inclined at a predetermined receding angle, and at least one of a curvature of the first exit surface in the longitudinal section and a curvature of the second entry surface in the longitudinal section is different in each longitudinal section.

According to this aspect, a vehicular lamp fitting which suppresses the generation of a relative drop of the luminous intensity in a part of the low beam light distribution pattern, is provided, even if the front lens body is disposed in an attitude that is inclined at a predetermined receding angle.

This is because at least one of a curvature of the first exit surface in the longitudinal section and a curvature of the second entry surface in the longitudinal section is different in each longitudinal section.

In addition, in a preferred aspect of the invention described above, the longitudinal section is a cross-section of the first exit surface or a cross-section of the second entry surface through which a horizontal ray group, which is included in each of a plurality of vertical surfaces having mutually different inclination angles, passes when the horizontal ray group, which is included in each of the plurality of vertical surfaces, enters the front lens body through the second exit surface, and the edge is disposed along a focal line which is formed by condensation of the horizontal ray group, which is included in each of the plurality of vertical surfaces, in the rear lens unit when the horizontal ray group exits through the second entry surface and enters the rear lens unit through the first exit surface.

In addition, in a preferred aspect of the invention described above, at least one of the curvature of the first exit surface in the longitudinal section and the curvature of the second entry surface in the longitudinal section is adjusted for each longitudinal section so that the focal line becomes a focal line extending in the vehicle width direction.

In addition, in a preferred aspect of the invention described above, the curvature of the first exit surface in the longitudinal section is adjusted for each longitudinal section so as to be larger as the distance between the second entry surface and the first exit surface, through which the horizontal ray group included in each of the plurality of vertical surfaces passes, is shorter.

In addition, in a preferred aspect of the invention described above, the curvature of the second entry surface in the longitudinal section is adjusted for each longitudinal section so as to be larger as the distance between the second entry surface and the first exit surface through which the horizontal ray group included in each of the plurality of vertical surfaces passes, is shorter.

Another aspect of the present invention provides a vehicular lamp fitting comprising: a front lens body; a rear lens unit disposed behind the front lens body; and a light source that is disposed behind the rear lens unit, and that emits light, which passes through the rear lens unit and the front lens body in this order and is irradiated forward, so as to form a low beam light distribution pattern, wherein the rear lens unit is a lens unit configured to condense, at least in a first direction, the light coming from the light source and passing through the rear lens unit, and includes: a first entry surface through which the light coming from the light source enters the rear lens unit; a first exit surface through which the light coming from the light source, which entered the rear lens unit, exits; and an edge which defines a cut-off line of the low beam light distribution pattern, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is disposed in an attitude that is inclined at a predetermined receding angle, the surface shape of at least one of the first exit surface and the second entry surface is adjusted so that when a horizontal ray group, which is included in each of a plurality of vertical surfaces having mutually different inclination angles, enters the rear lens unit through the front lens body from the front side of the front lens body, the horizontal ray group is condensed in the rear lens unit so as to form a focal line extending in the vehicle width direction, and the edge is disposed along the focal line.

Another aspect of the present invention provides a vehicular lamp fitting comprising: a front lens body; a rear lens unit disposed behind the front lens body; and a plurality of light sources that are disposed behind the rear lens unit, and that emit light, which passes through the rear lens unit and the front lens body in this order and is irradiated forward so as to form an ADB light distribution pattern, wherein the rear lens unit is a lens unit configured to condense, at least in a first direction, the light coming from the light sources and passing through the rear lens unit, and includes: a first entry surface through which the light coming from the light sources enters the rear lens unit; and a first exit surface through which the light coming from the light sources, which entered the rear lens unit, exits, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is disposed in an attitude that is inclined at a predetermined receding angle, and at least one of a curvature of the first exit surface in the longitudinal section, a curvature of the first entry surface in the longitudinal section, and a curvature of the second entry surface in the longitudinal section is different in each longitudinal section.

According to this aspect, a vehicular lamp fitting which suppresses the generation of a relative drop of the luminous intensity in a part of the low beam light distribution pattern, is provided, even if the front lens body is disposed in an attitude that is inclined at a predetermined receding angle.

This is because at least one of a curvature of the first exit surface in the longitudinal section, a curvature of the first entry surface in the longitudinal section, and a curvature of the second entry surface in the longitudinal section is different in each longitudinal section.

In addition, in a preferred aspect of the invention described above, the longitudinal section is a cross-section of the first exit surface, or a cross-section of the first entry surface or the second entry surface through which a horizontal ray group, which is included in each of the plurality of vertical surfaces having mutually different inclination angles, passes when the horizontal ray group, which is included in each of the vertical surfaces, enters the front lens body through the second exit surface, and the plurality of light sources are disposed along a focal line which is formed by condensation of the horizontal ray group, which is included in each of the plurality of vertical surfaces, behind the rear lens unit when the horizontal ray group passes through the front lens body and the rear lens unit.

In addition, in a preferred aspect of the invention described above, at least one of the curvature of the first exit surface in the longitudinal section, the curvature of the first entry surface in the longitudinal section, and the curvature of the second entry surface in the longitudinal section is adjusted for each longitudinal section so that the focal line becomes a focal line extending in the vehicle width direction.

In addition, in a preferred aspect of the invention described above, the curvature of the first exit surface in the longitudinal section is adjusted for each longitudinal section so as to be larger as the distance between the second entry surface and the first exit surface, through which the horizontal ray group included in each of the plurality of vertical surfaces passes, is shorter.

In addition, in a preferred aspect of the invention described above, the curvature of the first entry surface in the longitudinal section is adjusted for each longitudinal section so as to be larger as the distance between the second entry surface and the first exit surface through which the horizontal ray group included in each of the plurality of vertical surfaces passes, is shorter.

In addition, in a preferred aspect of the invention described above, the curvature of the second entry surface in the longitudinal section is adjusted for each longitudinal section so as to be larger as the distance between the second entry surface and the first exit surface through which the horizontal ray group included in each of the plurality of vertical surfaces passes, is shorter.

Another aspect of the present invention provides A vehicular lamp fitting comprising: a front lens body; a rear lens unit disposed behind the front lens body; and a plurality of light sources that are disposed behind the rear lens unit, and that emit light, which passes through the rear lens unit and the front lens body in this order and is irradiated forward, so as to form an ADB light distribution pattern, wherein the rear lens unit is a lens unit configured to condense, at least in a first direction, the light coming from the light sources and passing through the rear lens unit, and includes: a first entry surface through which the light coming from the light sources enters the rear lens unit; and a first exit surface through which the light coming from the light sources, which entered the rear lens unit, exits, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is disposed in an attitude that is inclined at a predetermined receding angle, and the surface shape of at least one of the first exit surface, the first entry surface and the second entry surface is adjusted so that when a horizontal ray group, which is included in each of a plurality of vertical surfaces having mutually different inclination angles, enters the rear lens unit through the front lens body from the front side of the front lens body, the horizontal ray group is condensed behind the rear lens unit so as to form a focal line extending in the vehicle width direction, and the plurality of light sources are disposed along the focal line.

In order to achieve the second object described above, an aspect of the present invention provides a vehicular lamp fitting comprising: a front lens body; a rear lens unit disposed behind the front lens body; and a plurality of light sources that are disposed behind the rear lens unit, and that emit light, which passes through the rear lens unit and the front lens body in this order and is irradiated forward, so as to form an ADB light distribution pattern, wherein the rear lens unit is a lens unit configured to condense, at least in a first direction, the light coming from the light sources and passing through the rear lens unit, and includes: a first entry surface through which the light coming from the light sources enters the rear lens unit; and a first exit surface through which the light coming from the light sources, which entered the rear lens unit, exits, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is disposed in an attitude that is inclined at a predetermined upward angle, a surface shape of at least one of the first exit surface, the first entry surface, and the second entry surface is adjusted so that a focal line of a projection lens constituted by the front lens body and the rear lens unit is a focal line extending in the horizontal direction, and the plurality of light sources are disposed along the focal line.

According to this aspect, a vehicular lamp fitting, which suppresses the generation of the ADB light distribution pattern in the state of being diagonally deformed (diagonal blur state), can be provided, even if the front lens body is disposed in an attitude that is inclined at a predetermined upward angle.

This is because a surface shape of at least one of the first exit surface, the first entry surface, and the second entry surface is adjusted so that the focal line of the projection lens formed by the front lens body and the rear lens unit becomes a focal line extending in the horizontal direction.

In addition, in a preferred aspect of the invention described above, the longitudinal section of the first entry surface includes:

a first longitudinal section including a first curve which has a first vertex, a first partial curve which extends linearly from the first vertex diagonally upward in the backward direction, and a second partial curve which extends linearly from the first vertex diagonally downward in the backward direction; and a second longitudinal section including a first curve which has a second vertex, an inflection point, a third partial curve which extends upward from the inflection point and is convex in the forward direction, and a fourth partial curve which extends downward from the inflection point and is convex in the backward direction, the first entry surface is a curved surface configured such that the surface shape gradually changes in a direction from the first curve to the second curve, and includes: a convex portion which extends linearly between the first vertex and the inflection point, and is convex in the forward direction; an upper surface which is disposed on the upper side of the linearly extending convex portion; and a lower surface which is disposed on the lower side of the convex portion, and the convex portion extends linearly in a direction which is inclined with respect to the reference axis at a predetermined angle in the opposite direction of the predetermined upward angle when viewed from the back.

In addition, in a preferred aspect of the invention described above, the upper surface is a curved surface configured such that the surface shape gradually changes in a direction from the first partial curve to the third partial curve, and the lower surface is a curved surface configured such that the surface shape gradually changes in a direction from the second partial curve to the fourth partial curve.

DESCRIPTION OF EMBODIMENTS

Embodiment 1

A vehicular lamp fitting 10 according to Embodiment 1 of the present invention will be described below with reference to the attached drawings. In each drawing, a corresponding composing element is denoted with a same reference symbol, and redundant description thereof will be omitted.

Figure 1:
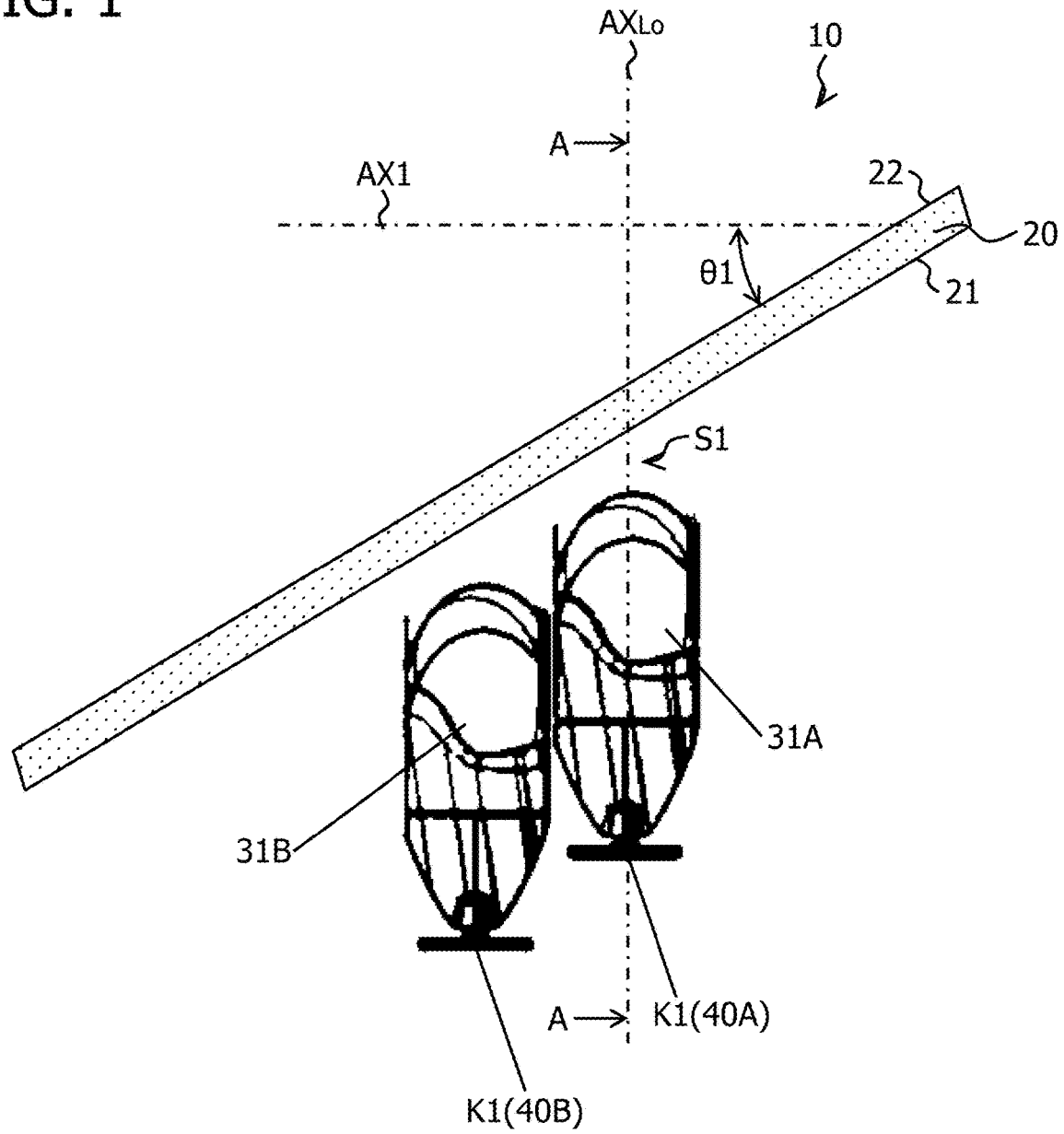
FIG. 1 is a top view of the vehicular lamp fitting 10.
Figure 2:
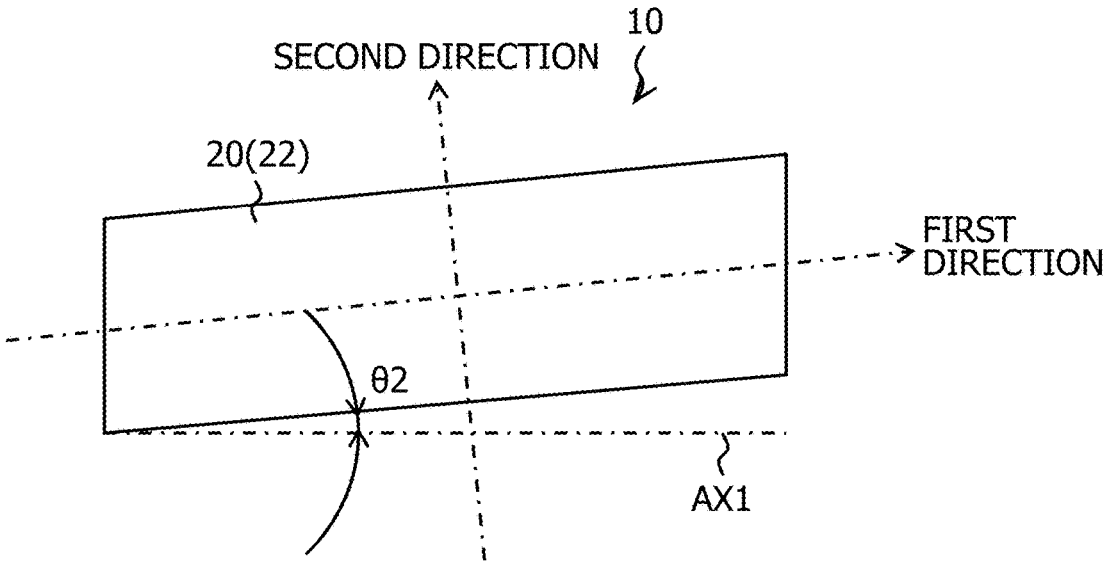
FIG. 2 is a front view of the vehicular lamp fitting 10.

FIG. 1 is a top view of the vehicular lamp fitting 10. FIG. 2 is a front view of the vehicular lamp fitting 10.

The vehicular lamp fitting 10 shown in FIGS. 1 to 2 is a vehicular headlamp (headlamp) that can form a low beam light distribution pattern and is mounted to, for example, the left and right sides on the front end of a vehicle such as an automobile. Because the vehicular lamp fitting 10 to be mounted to both the left and right sides has a symmetrical configuration, a vehicular lamp fitting 10 mounted to the left side at the front of a vehicle (left side facing the front of the vehicle) is described as a representative example of the vehicular lamp fitting 10. Although not illustrated, the vehicular lamp fitting 10 is arranged in a lamp chamber constituted by an outer lens and a housing and is attached to the housing or the like.

As illustrated in FIG. 1 and FIG. 2, the vehicular lamp fitting 10 includes: a front lens body 20; a plurality of rear lens units 31A and 31B disposed behind the front lens body 20; and a plurality of light sources 40A and 40B, that are disposed behind the plurality of rear lens units 31A and 31B, and that emit respective light which passes through the rear lens units 31A and 31B and the front lens body 20 in this order, and is irradiated forward, so as to form a low beam light distribution pattern. The rear lens units 31A and 31B have the same configuration, and the light sources 40A and 40B have the same configuration. The rear lens units 31A and 31B are collectively referred to as "rear lens units 31" in the following description if the rear lens units 31A and 31B do not need to be distinguished from each other. Likewise, the light sources 40A and 40B are collectively referred to as "light sources 40" in the following description if the light sources 40A and 40B do not need to be distinguished from each other. A number of rear lens units 31 and a number of light sources 40 may be one respectively.

The front lens body 20 and the rear lens unit 31 are made of transparent resin such as acrylic and polycarbonate. The front lens body 20 and the rear lens unit 31 are separately molded in a physically separated state by injection molding. The front lens body 20 and the rear lens unit 31 are configured as a lens body connected by a holding member (not shown) such as a lens holder.

The front lens body 20 is a lens unit extending in a predetermined direction (also referred to as a first direction herein). The first direction is, for example, a direction inclined, with respect to a reference axis AX1 which extends in the vehicle width direction, at a receding angle θ1 when viewed from the top, as illustrated in FIG. 1, and also is a direction inclined, with respect to the reference axis AX1, at a upward angle θ2 when viewed from the front, as illustrated in FIG. 2. The angle θ1 is any angle that is greater than 0 and less than 90°. The angles θ2 is any angles from between 0° to 90°. To simplify description, an example where θ1 is 30° and θ2 is 0° will be described.

In a general vehicular lamp fitting, one projection lens is responsible for condensing light in the first direction and light in the second direction orthogonal to the first direction. In contrast, in this embodiment, two lenses (the front lens body 20 and the rear lens unit 31) which make up a projection lens are responsible for condensing light in the first direction and light in the second direction orthogonal to the first direction. More specifically, in this embodiment, the rear lens unit 31 is mainly responsible for condensing light in the first direction and the front lens body 20 is mainly responsible for condensing light in the second direction.

Figure 3:
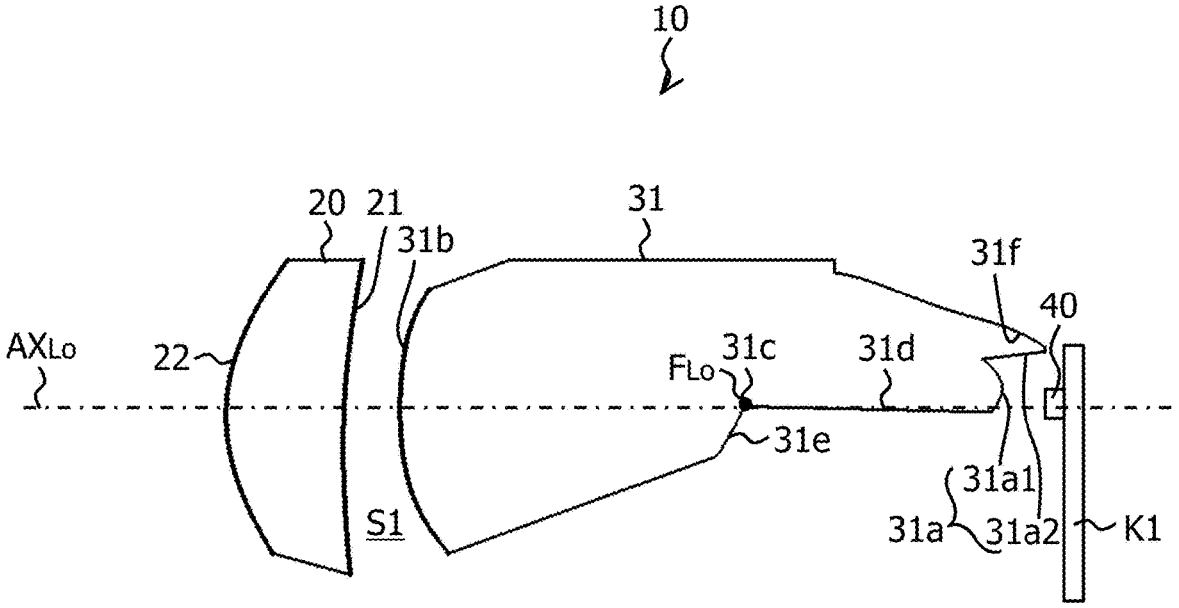
FIG. 3 is an A-A cross-sectional view of the vehicular lamp fitting 10 illustrated in FIG. 1.

FIG. 3 is an A-A cross-sectional view of the vehicular lamp fitting 10 illustrated in FIG. 1. In FIG. 1, FIG. 3 and the like, the dotted line extending in the vehicle length direction, indicated by the reference symbol $AX_{Lo}$, is an optical axis of a projection lens which is configured by the front lens body 20 and the rear lens unit 31. This optical axis is hereafter referred to as the optical axis $AX_{Lo}$.

As illustrated in FIG. 3, the front lens body 20 includes a second entry surface 21 and a second exit surface 22 disposed on the opposite side of the second entry surface 21. The second entry surface 21 and the second exit surface 22 extend in the first direction (e.g. direction orthogonal to the paper surface in FIG. 3) respectively.

In concrete terms, as illustrated in FIG. 3, the second entry surface 21 is configured as a cylindrical surface that is convex in the forward direction and of which cylindrical axis extends in the first direction. The second exit surface 22 is configured as a cylindrical surface that is convex in the forward direction and of which cylindrical axis extends in the first direction. The curvature (curvature of a cross-section orthogonal to the first direction) of the second entry surface 21 is the same in each cross-section. The curvature (curvature of a cross-section orthogonal to the first direction) of the second exit surface 22 is the same in each cross-section. The second entry surface 21 and the second exit surface 22 may be a plane or a planar surface.

The light source 40 is a semiconductor light emitting element such as an LED or LD having a rectangular (for example, a 1 $mm^2$) light emitting surface and is mounted to a substrate K1 with the light emitting surface facing forward (to the front). The substrate K1 is mounted to the housing (not shown) using a screw or another means.

The rear lens unit 31 includes a first entry surface 31*a*, a first exit surface 31*b* on the side opposite to the first entry surface 31*a*, an edge portion 31*c* provided (at a focal point $F_{Lo}$) between the first entry surface 31*a* and the first exit surface 31*b*, a reflection surface 31*d* extending toward the rear from the edge portion 31*c*, an extension surface 31*e* extending downward from the edge portion 31*c*, and a peripheral reflection surface 31*f*.

The first entry surface 31*a* includes: a central entry surface 31*a*1 which is convex toward the light source 40; and a tubular-shaped peripheral entry surface 31*a*2, which extends backward from (all or a part of) a peripheral edge of the central entry surface 31*a*1, and surrounds a space between the central entry surface 31*a*1 and the light source 40.

The central entry surface 31*a*1 is a surface through which light in a narrow angle direction with respect to the optical axis $AX_{Lo}$ (which matches with the optical axis of the light source 40), out of the light coming from the light source 40, enters the rear lens unit 31. The central entry surface 31*a*1 is configured as a surface to condense the light coming from the light source 40, which enters the rear lens unit 31 through the central entry surface 31*a*1, in the vicinity of a focal point $F_{Lo}$ (edge 31*c*), for example. In reality, the light source 40 is not a point light source but has a certain size, therefore the light coming from the light source 40, which enters the rear lens unit 31 through the central entry surface 31*a*1, is not perfectly condensed to one point (focal point $F_{Lo}$) but is condensed in the vicinity of the focal point $F_{Lo}$ (edge 31*c*).

The focal point $F_{Lo}$ is a condensed point on the optical axis $AX_{Lo}$ in the rear lens unit 31, when horizontal rays, which are parallel with the optical axis $AX_{Lo}$, enter the rear lens unit 31 through the front lens body 20 from the front side of the front lens body 20.

The peripheral entry surface 31*a*2 is a surface through which light in a wide angel direction with respect to the optical axis $AX_{Lo}$, out of the light from the light coming from the light source 40, enters the rear lens unit 31. The light coming from the light source 40, which enters the rear lens unit 31 through the peripheral entry surface 31*a*2, is internally reflected (total reflection) by a peripheral reflection surface 31*f*.

The peripheral reflection surface 31*f* is configured as a surface to condense the light coming from the light source 40, which enters the rear lens unit 31 through the peripheral entry surface 31*a*2 and is internally reflected (total reflection) by the peripheral reflection surface 31*f*, in the vicinity of the focal point $F_{Lo}$ (edge 31*c*). In reality, the light source 40 is not a point light source but has a certain size, therefore the light coming from the light source 40, which enters the rear lens unit 31 through the peripheral entry surface 31*a*2, is not perfectly condensed to one point (focal point $F_{Lo}$) but is condensed in the vicinity of the focal point $F_{Lo}$ (edge 31*c*).

The first exit surface 31*b* is a surface through which the light coming from the light source 40, which entered the rear lens unit 31 through the first entry surface 31*a*, exits.

Figure 4:
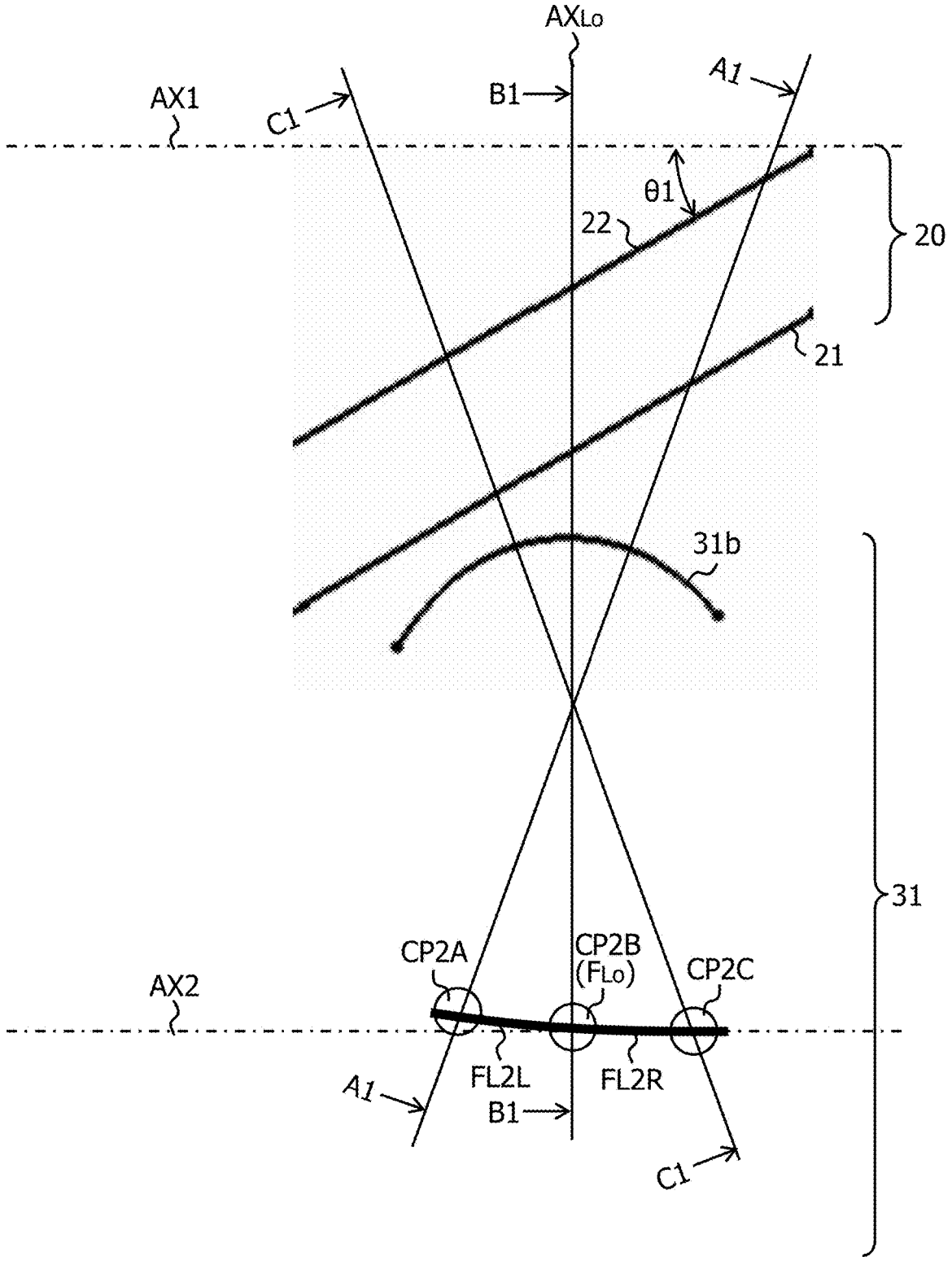
FIG. 4 is a lateral sectional view of the vehicular lamp fitting 10 (portions other than the major optical surface are omitted)

FIG. 4 is a lateral sectional view of the vehicular lamp fitting 10 (portions other than the major optical surface are omitted).

As illustrated in FIG. 4, the first exit surface 31*b* is configured as a curved surface that is convex in the forward direction in the lateral section. The curvature of the first exit surface 31*b* is the same in each lateral section. On the other hand, the curvature of the first exit surface 31*b* is not the same in each longitudinal section, but is different in each longitudinal section. For example, the curvature of the first exit surface 31*b* in the longitudinal section is different in the A1-A1 cross-section, B1-B1 cross section, and C1-C1 cross section respectively in FIG. 4. The B1-B1 cross-section is a longitudinal sectional which includes the optical axis $AX_{Lo}$. The A1-A1 cross-section is a cross-section which intersects with the optical axis $AX_{Lo}$ inside the rear lens unit 31 at a point ahead of the later mentioned condensed point CP2B. The A1-A1 cross section is a longitudinal cross section inclined in the same direction as the front lens body 20 with respect to the optical axis $AX_{Lo}$. The C1-C1 cross-section is a cross-section which intersects with the optical axis $AX_{Lo}$ inside the rear lens unit 31 at a point ahead of the later mentioned condensed point CP2B. The C1-C1 cross section is a longitudinal cross section inclined in the opposite direction as the front lens body 20 with respect to the optical axis $AX_{Lo}$. The A1-A1 cross-section, the B1-B1 cross-section and the C1-C1 cross-section all intersect at a same position inside the rear lens 31. In other words, the A1-A1 cross-section and the C1-C1 cross-section are vertical sections of which intersections with respect to the optical axis $AX_{Lo}$ are at the same position, but inclination angles are different. It will be described later how the curvature of the longitudinal cross section of the first exit surface 31*b* differs in each longitudinal cross section.

The edge 31*c* is disposed along the focal line, as mentioned later. The edge 31*c* has a Z-shaped step difference (not illustrated), for example.

Figure 6:
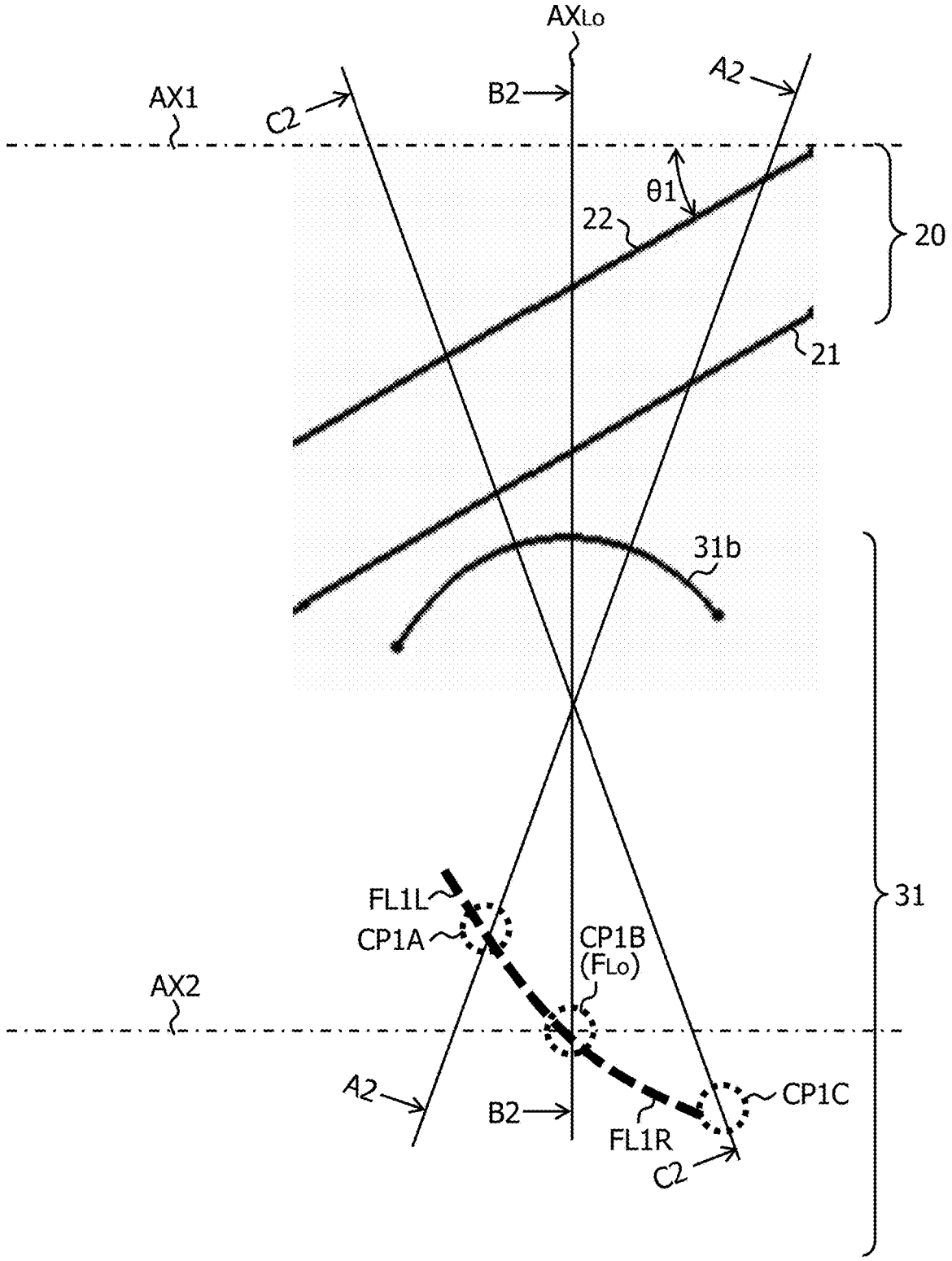
FIG. 6 is a lateral sectional view of the vehicular lamp fitting 10 (portions other than the major optical surface are omitted)

The focal line is a group of condensed points which are formed in the rear lens unit 31, when a plurality of horizontal rays, which are included in a plurality of vertical surfaces having mutually different inclination angles with respect to the optical axis $AX_{Lo}$ respectively, enter the rear lens unit 31 through the front lens body 20 from the front side of the front lens body 20. The solid lines indicated by the reference symbols FL2L and FL2R in FIG. 4 and the dotted lines indicated by the reference symbols FL1L and FL1R in FIG. 6 are examples of the focal line. These lines are hereafter referred to as the focal line FL1L, focal line FL1R, focal line FL2L and focal line FL2R. The focal lines FL1L, FL1R, FL2L and FL2R will be described in detail later.

In the vehicular lamp fitting 10 having the above-described configuration, when the light sources 40 is turned on, the light from the light sources 40 enters the rear lens units 31 from the first entry surface 31*a* and condenses in the vicinity of the focal point $F_{Lo}$ (edge 31*c*). Then, the light is partially blocked (shaded) by the reflection surface 31*d* and exits from the first exit surface 31*b* together with light reflected off the reflection surface 31*d*. At this time, the first exit surface 31*b* (lateral section of the first exit surface 31*b*) acts to condense, in the first direction, the light from the light source 40 which exits the first exit surface 31*b*. Then, the light from the light source 40 which has exited the first exit surface 31*b* passes through a space S1 between the rear lens unit 31 and the front lens body 20, further enters the front lens body 20 from the second entry surface 21 and is irradiated forward after exiting the second exit surface 22. At this time, the second exit surface 22 acts to condense, in the second direction, the light from the light source 40 which exits the second exit surface 22. Thereby, the low beam light distribution pattern is formed. The low beam light distribution pattern includes a cut-off line defined by the edge 31*c* at the upper end edge.

In other words, the light intensity distribution is formed in the vicinity of the edge 31*c* by the light from the light source 40 that has entered the rear lens unit 31. The rear lens unit 31 and the front lens body 20 (which are functioning as a projection lens) project the light intensity distribution forward. Thereby, a low beam light distribution pattern is formed.

A low beam light distribution pattern which is formed when a curvature of the first exit surface 31*b* in the longitudinal section is the same in each longitudinal section will be described next.

Figure 5A:
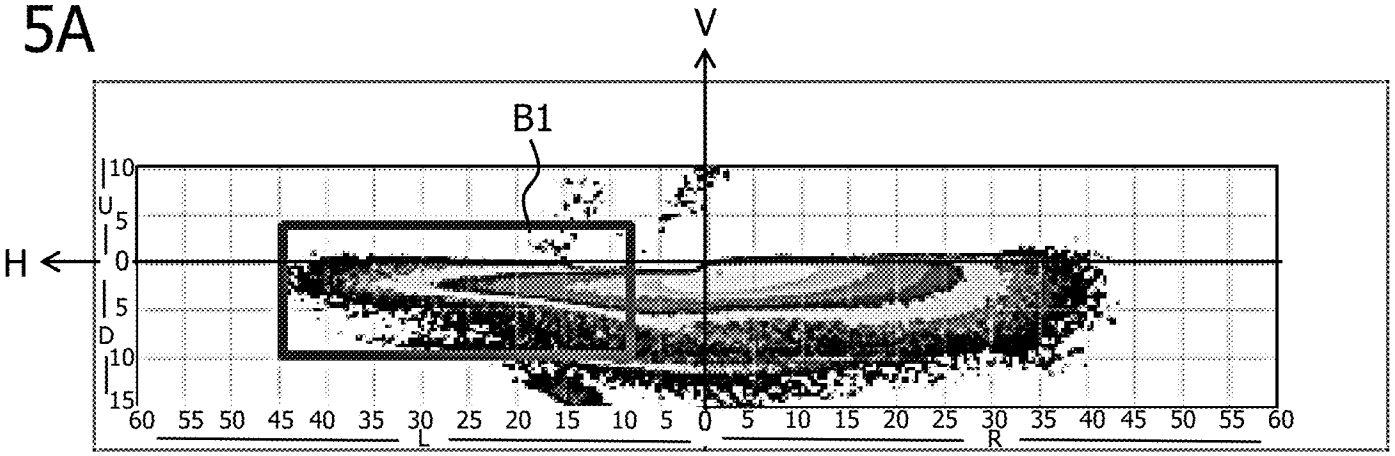
FIG. 5A is an example of the low beam light distribution pattern which is formed when a curvature of the first exit surface 31*b* in the longitudinal section is the same in each longitudinal section.

FIG. 5A is an example of the low beam light distribution pattern which is formed when a curvature of the first exit surface 31*b* in the longitudinal section is the same in each longitudinal section. FIG. 5A indicates an example of the low beam light distribution pattern which is formed on a virtual vertical screen facing the front surface of the vehicle (disposed at 25 m in the forward direction from the front surface of the vehicle).

The present inventors performed simulation and confirmed that a relative drop of the luminous intensity in a part of the low beam light distribution pattern is generated (a blurred state is generated) when the front lens body 20 is disposed in an attitude that is inclined with respect to the reference axis AX1 at a receding angle θ1, when viewed from the top, if the curvature of the first exit surface 31*b* in the longitudinal section is the same in each longitudinal section, as illustrated in FIG. 1.

Figure 5B:
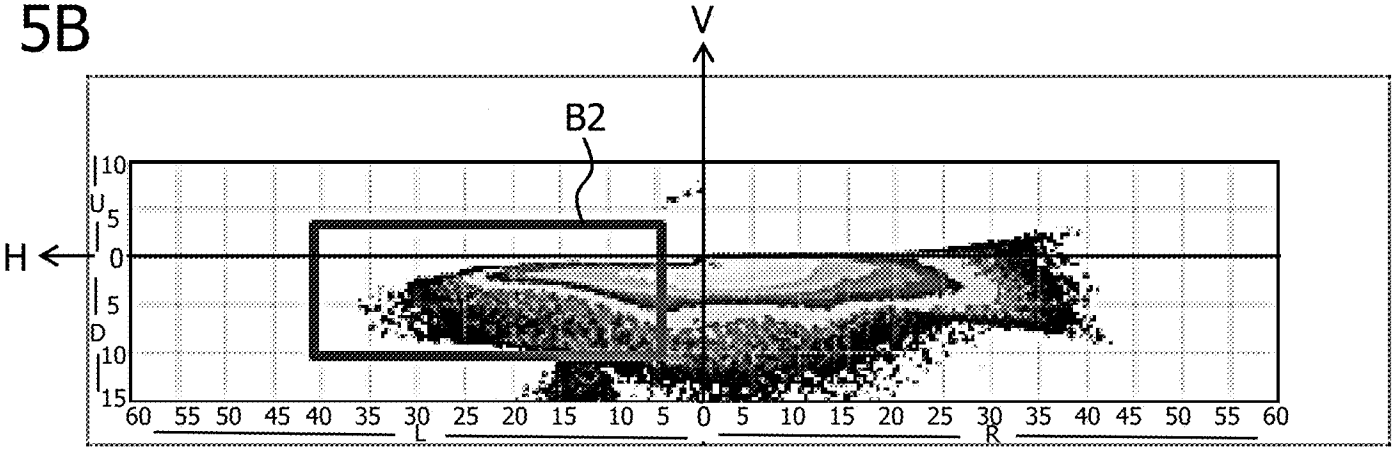
FIG. 5B is an example of the low beam light distribution pattern which is formed when the curvature of the first exit surface 31*b* in the longitudinal section is adjusted for each longitudinal section.

According to FIG. 5A, the luminous intensity around the cut-off area at 5 to 20° to the left is lower than the luminous intensity around the cut-off area at 5 to 20° to the right, for example, and a relative drop of the luminous intensity is generated in a part of the low beam light distribution pattern (a range enclosed by square B1 in FIG. 5A). In FIG. 5A and FIG. 5B, one square (each grid) indicates 5° longitudinally (vertical V direction) and 5° laterally (horizontal H direction). This is the same in FIG. 13. The reason for the drop of the luminous intensity in a part of the low beam light distribution pattern will be described below.

First the focal line that is formed when the curvature of the first exit surface 31*b* in the longitudinal section is the same in each longitudinal section will be described with reference to FIG. 6 and FIGS. 7A to 7C. FIG. 6 is the same as FIG. 4, except that the curvature of the first exit surface 31*b* in the longitudinal section is the same in each longitudinal section, and the positions of the focal lines and focal points (condensed points) are different.

FIG. 6 is a lateral sectional view of the vehicular lamp fitting 10 (portions other than the major optical surface are omitted). In FIG. 6, the focal lines FL1L and FL1R, which are formed when the curvature of the first exit surface 31*b* in the longitudinal section is the same in each longitudinal section, are indicated.

Figure 7A:
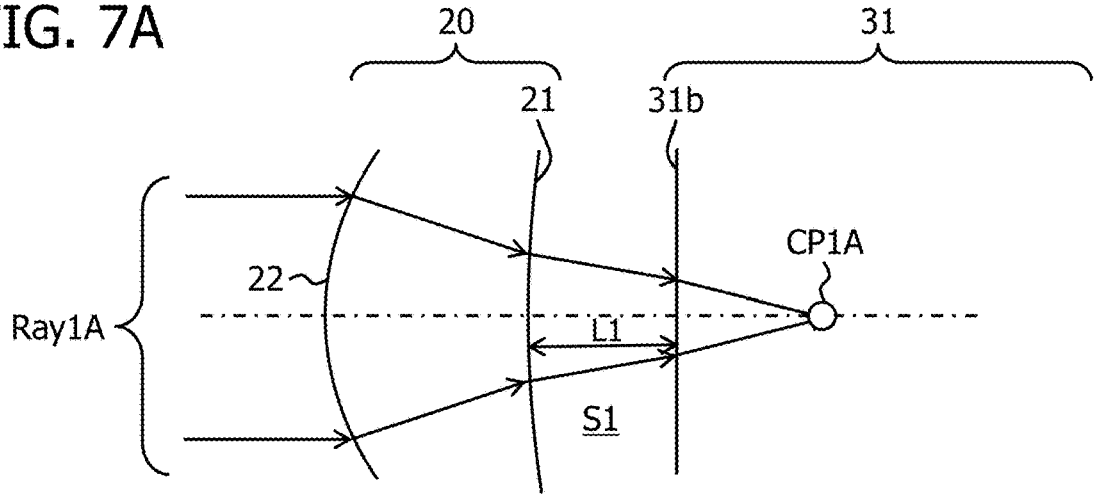
FIG. 7A indicates A2-A2 cross-section (longitudinal section) in FIG. 6, FIG. 7B indicates B2-B2 cross-section (longitudinal section) in FIG. 6, and FIG. 7C indicates C2-C2 cross-section (longitudinal section) in FIG. 6.

FIG. 7A indicates A2-A2 cross-section (longitudinal section) in FIG. 6. In FIG. 7A, a horizontal ray group Ray 1A, which passes through the A2-A2 cross-section of the front lens body 20, is illustrated.

As illustrated in FIG. 7A, when the horizontal ray group Ray 1A included in the A2-A2 cross-section enters the rear lens unit 31 through the front lens body 20, the horizontal ray group condenses at a point ahead of the focal point $F_{Lo}$ (see FIG. 7B), and forms a condensed point CP1A.

In the same manner, when the horizontal ray group included in each of a plurality of longitudinal sections (a plurality of longitudinal sections having mutually different inclination angles with respect to the optical axis $AX_{Lo}$) between the A2-A2 cross-section and the B2-B2 cross-section enters the rear lens unit 31 through the front lens body 20 as well, the horizontal ray group condenses at a point ahead of the focal point $F_{Lo}$ and forms a condensed point (group), although this is not illustrated.

The condensed point group, such as the condensed point CP1A, formed by being condensed at a point ahead of the focal point $F_{Lo}$ like this, constitutes the focal line FL1L, as indicated by the dotted line on the left side of the optical axis $AX_{Lo}$ in FIG. 6.

Figure 7B:
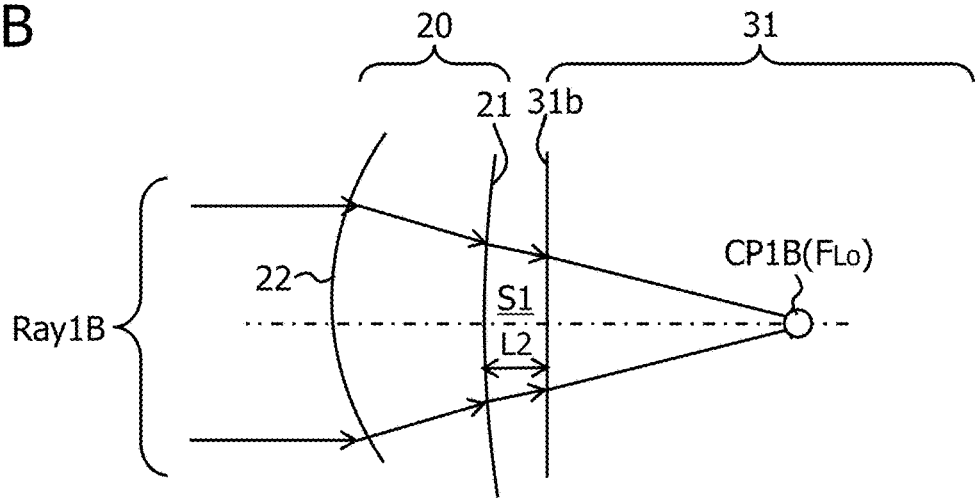

FIG. 7B indicates B2-B2 cross-section (longitudinal section) in FIG. 6. In FIG. 7B, a horizontal ray group Ray 1B, which passes through the B2-B2 cross-section of the front lens body 20, is illustrated.

As illustrated in FIG. 7B when the horizontal ray group Ray 1B included in the B2-B2 cross-section enters the rear lens unit 31 through the front lens body 20, the horizontal ray group condenses at the focal point $F_{Lo}$, and forms a condensed point CP1B.

Figure 7C:
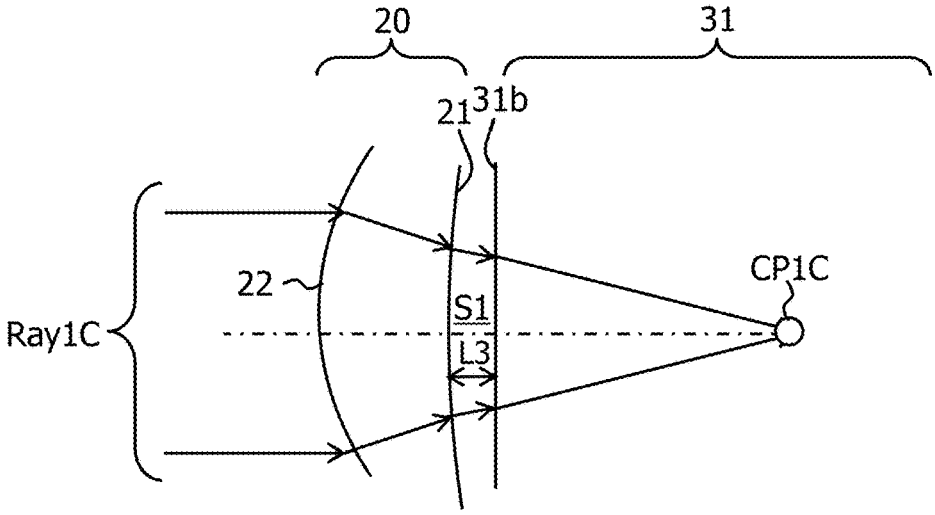

FIG. 7C indicates C2-C2 cross-section (longitudinal section) in FIG. 6. In FIG. 7C, a horizontal ray group Ray 1C, which passes through the C2-C2 cross-section of the front lens body 20, is illustrated.

As illustrated in FIG. 7C when the horizontal ray group Ray 1C included in the C2-C2 cross-section enters the rear lens unit 31 through the front lens body 20, the horizontal ray group condenses at a point behind of the focal point $F_{Lo}$, and forms a condensed point CP1C.

In the same manner, when the horizontal ray group included in each of a plurality of longitudinal sections (a plurality of longitudinal sections having mutually different inclination angles with respect to the optical axis $AX_{Lo}$) between the B2-B2 cross-section and the C2-C2 cross-section enters the rear lens unit 31 through the front lens body 20 as well, the horizontal ray group condenses at a point behind the focal point $F_{Lo}$ and forms a condensed point (group), although this is not illustrated.

The condensed point group, such as the condensed point CP1C, formed by being condensed at a point behind of the focal point $F_{Lo}$ like this, constitutes the focal line FL1R, as indicated by the dotted line on the right side of the optical axis $AX_{Lo}$ in FIG. 6.

The focal line FL1L and the focal line FL1R are laterally asymmetric with respect to the optical axis $AX_{Lo}$ in FIG. 6. This is because the distance between the second entry surface 21 and the first exit surface 31*b*, through which each horizontal ray group passes through, is different depending on the horizontal ray group (e.g. see the distances L1, L2 and L3 in FIG. 7, L1>L2>L3).

The optical path of the light coming from the light source 40 that passes through the vicinity of the focal lines FL1L and FL1R (edges 31*c* disposed along the focal lines FL1L and FL1R), configured as above, will be described with reference to FIGS. 8A to 8C.

Figure 8A:
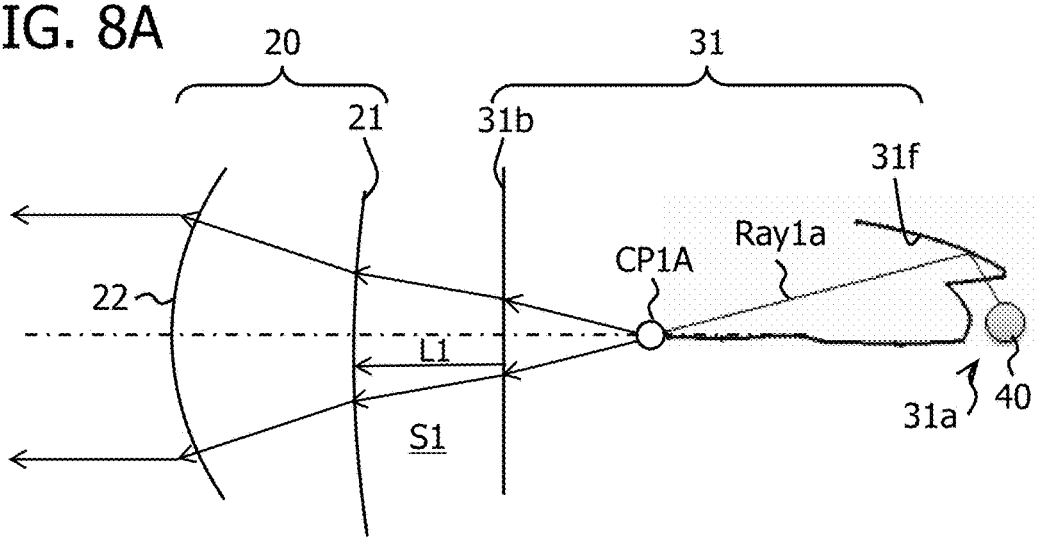
FIG. 8A is the A2-A2 cross-section (longitudinal section) in FIG. 6.

FIG. 8A is the A2-A2 cross-section (longitudinal section) in FIG. 6. In FIG. 8A, a light Ray 1*a* from the light source 40, that passes through the A2-A2 cross-section in the rear lens unit 31, is illustrated.

As illustrated in FIG. 8A, in the A2-A2 cross-section, the light Ray 1*a* from the light source 40, which entered the rear lens unit 31 through the first entry surface 31*a* (peripheral entry surface 31*a*2), is internally reflected by the peripheral reflection surface 31*f*, and passes through the vicinity of the condensed point CP1A (focal line FL1L), passes through the vicinity of the condensed point CP1A at a relatively shallow angle (angle within a capture angle of the first exit surface 31*b*). Therefore the light Ray 1*a* exits through the first exit surface 31*b*, passes through the front lens body 20, and is irradiated forward, so as to form the low beam light distribution pattern.

This is the same for the light coming from the light source 40, which enters the rear lens unit 31 through the first entry surface 31*a* (peripheral entry surface 31*a*2), is internally reflected by the peripheral reflection surface 31*f*, and passes through the condensed point (focal line FL1L), in each of a plurality of longitudinal sections (a plurality of longitudinal sections having mutually different inclination angles with respect to the optical axis $AX_{Lo}$) between the A2-A2 cross-section and the B2-B2 cross-section, although this is not illustrated.

Figure 8B:
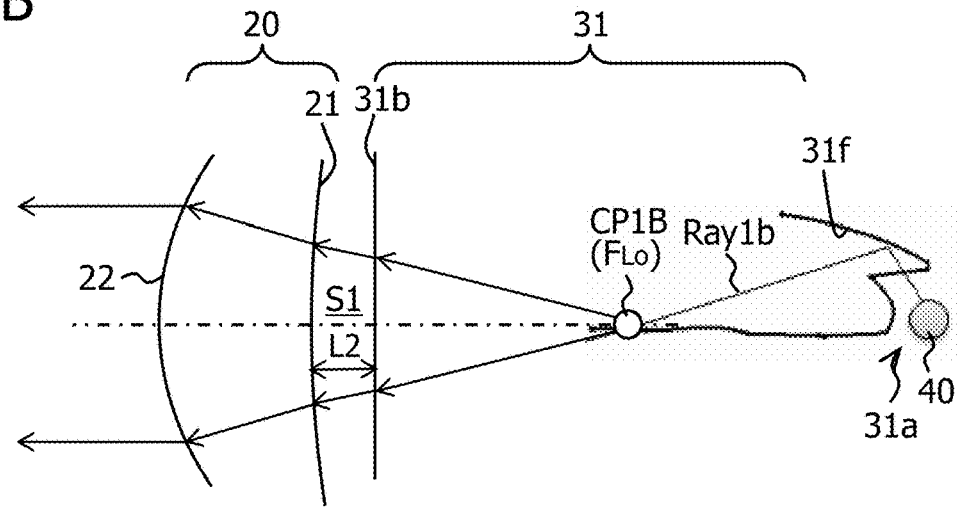
FIG. 8B is the B2-B2 cross-section (longitudinal section) in FIG. 6.

FIG. 8B is the B2-B2 cross-section (longitudinal section) in FIG. 6. In FIG. 8B, a light Ray 1*b* from the light source 40, that passes through the B2-B2 cross-section in the rear lens unit 31, is illustrated.

As illustrated in FIG. 8B, in the B2-B2 cross-section, the light Ray 1*b* from the light source 40, which entered the rear lens unit 31 through the first entry surface 31*a* (peripheral entry surface 31*a*2), is internally reflected by the peripheral reflection surface 31*f*, and passes through the vicinity of the condensed point CP1B (focal point $F_{Lo}$), passes through the vicinity of the condensed point CP1B (focal point $F_{Lo}$) at a relatively shallow angle (angle within a capture angle of the first exit surface 31*b*). Therefore the light Ray 1*b* exits through the first exit surface 31*b*, passes through the front lens body 20, and is irradiated forward, so as to form the low beam light distribution pattern.

Figure 8C:
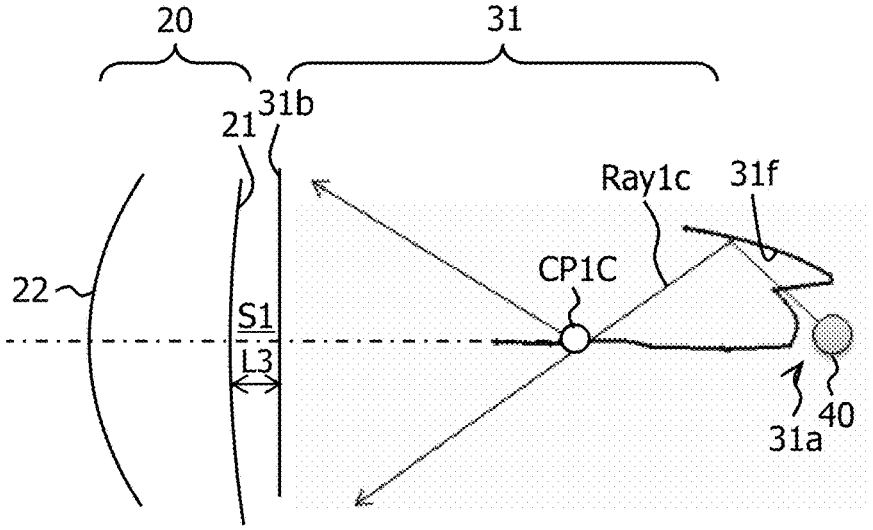
FIG. 8C is the C2-C2 cross-section (longitudinal section) in FIG. 6.

FIG. 8C is the C2-C2 cross-section (longitudinal section) in FIG. 6. In FIG. 8C, a light Ray 1*c* from the light source 40, that passes through the C2-C2 cross-section in the rear lens unit 31, is illustrated.

As illustrated in FIG. 8C, in the C2-C2 cross-section, the light Ray 1*c* from the light source 40, which entered the rear lens unit 31 through the first entry surface 31*a* (peripheral entry surface 31*a*2), is internally reflected by the peripheral reflection surface 31*f*, and passes through the vicinity of the condensed point CP1C (focal line FL1R), passes through the vicinity of the condensed point CP1C at a relatively deep angle (angle outside a capture angle of the first exit surface 31*b*). Therefore the light Ray 1*c* does not exits through the first exit surface 31*b*, and is not used to form the low beam light distribution pattern.

This is the same for the light coming from the light source 40, which enters the rear lens unit 31 through the first entry surface 31*a* (peripheral entry surface 31*a*2), is internally reflected by the peripheral reflection surface 31*f*, and passes through the condensed point (focal line FL1R), in each of a plurality of longitudinal sections (a plurality of longitudinal sections having mutually different inclination angles with respect to the optical axis $AX_{Lo}$) between the B2-B2 cross-section and the C2-C2 cross-section, although this is not illustrated.

The light coming from the light source 40, such as Ray 1*c*, which passes through the vicinity of the focal line FL1R, passes through the vicinity of the edge 31*c* (focal line FL1R) at a relatively deep angle (an angle other than a capture angle of the first exit surface 31*b*). Therefore the light does not exit through the first exit surface 31*b*, and is not used to form the low beam light distribution pattern. As a result, the luminous intensity drops in a part of the low beam light distribution pattern (in a range enclosed by the square B1 in FIG. 5A).

A configuration to suppress the relative drop of the luminous intensity in a part of the low beam light distribution pattern will be described next.

As a result of intensive studies to suppress the generation of the relative drop of the luminous intensity in a part of the low beam light distribution pattern, the present inventors discovered that the generation of the relative drop of the luminous intensity in a part of the low beam light distribution pattern can be suppressed by adjusting the curvature of the first exit surface 31*b* in the longitudinal section for each longitudinal section.

This adjustment is an adjustment for correcting the focal lines FL1L and FL1R shown in FIG. 6 into focal lines (e.g. focal lines FL2L and FL2R shown in FIG. 4) extending in the vehicle width direction. This adjustment is performed using a predetermined simulation software.

The focal lines that are generated after adjusting the curvature of the first exit surface 31*b* in the longitudinal section for each longitudinal section will be described next with reference to FIGS. 9A to 9C. FIG. 4 indicates the focal lines FL2L and FL2R which are formed after adjusting the curvature of the first exit surface 31*b* in the longitudinal section for each longitudinal section.

Figure 9A:
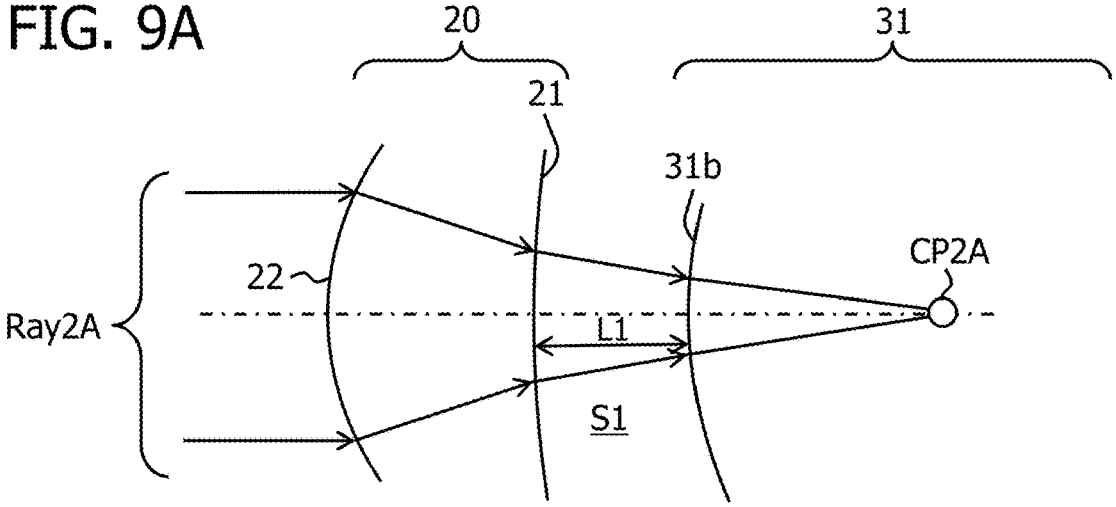
FIG. 9A indicates the A1-A1 cross-section (longitudinal section) in FIG. 4, FIG. 9B indicates the B1-B1 cross-section (longitudinal section) in FIG. 4, and FIG. 9C indicates the C1-C1 cross-section (longitudinal section) in FIG. 4.

FIG. 9A indicates the A1-A1 cross-section (longitudinal section) in FIG. 4. In FIG. 9A, the horizontal ray group Ray 2A, which passes through the A1-A1 cross-section of the front lens body 20, is illustrated. In FIG. 9A, the curvature of the first exit surface 31*b* in the longitudinal section is adjusted (set) to a first curvature, so that when the horizontal ray group Ray 2A included in the A1-A1 cross-section enters the rear lens unit 31 through the front lens body 20, the horizontal ray group is condensed and forms a condensed point CP2A in the vicinity of the reference axis AX2 (see FIG. 4). As illustrated in FIG. 4, the reference axis AX2 is a horizontal line that is orthogonal to the optical axis $AX_{Lo}$, for example, and passes through the focal point $F_{Lo}$.

In the same manner, the curvature of each of a plurality of longitudinal sections (a plurality of longitudinal sections having mutually different inclination angles with respect to the optical axis $AX_{Lo}$) between the A1-A1 cross-section and the B1-B1 cross-section is also adjusted (set) so that when the horizontal ray group included in each of the plurality of longitudinal sections enters the rear lens unit 31 through the front lens body 20, the horizontal ray group is condensed and forms a condensed point (group) in a vicinity of the reference axis AX2 (not shown).

By adjusting the curvature like this, the condensed point group, such as CP2A, forms the focal line FL2L which extends in the vehicle width direction along the reference axis AX2, as indicated by the solid line on the left side of the optical axis $AX_{Lo}$ in FIG. 4.

Figure 9B:
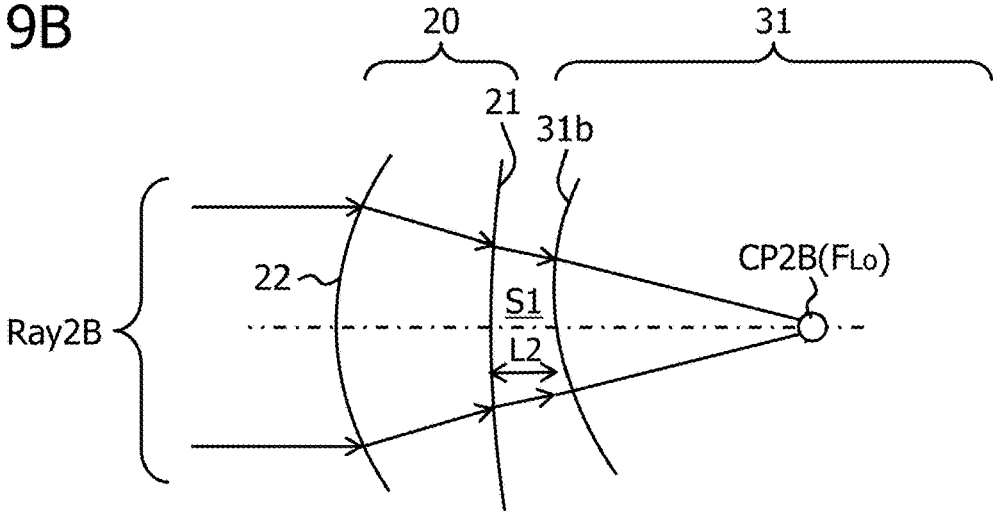

FIG. 9B indicates the B1-B1 cross-section (longitudinal section) in FIG. 4. In FIG. 9B, the horizontal ray group Ray 2B, which passes through the B1-B1 cross-section of the front lens body 20, is illustrated. In FIG. 9B, the curvature of the first exit surface 31*b* in the longitudinal section is adjusted (set) to a second curvature (the second curvature>first curvature), so that when the horizontal ray group Ray 2B included in the B1-B1 cross-section enters the rear lens unit 31 through the front lens body 20, the horizontal ray group is condensed and forms a condensed point CP2B in the vicinity of the reference axis AX2 (see FIG. 4).

Figure 9C:
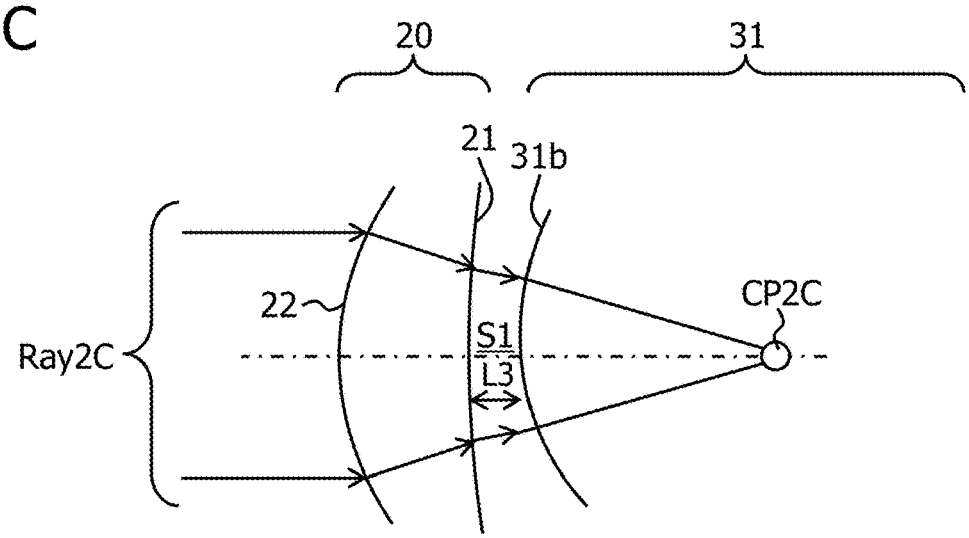

FIG. 9C indicates the C1-C1 cross-section (longitudinal section) in FIG. 4. In FIG. 9C, the horizontal ray group Ray 2C, which passes through the C1-C1 cross-section of the front lens body 20, is illustrated. In FIG. 9C, the curvature of the first exit surface 31*b* in the longitudinal section is adjusted (set) to a third curvature (the third curvature>the second curvature), so that when the horizontal ray group Ray 2C included in the C1-C1 cross-section enters the rear lens unit 31 through the front lens body 20, the horizontal ray group is condensed and forms a condensed point CP2C in the vicinity of the reference axis AX2 (see FIG. 4).

In the same manner, the curvature of each of a plurality of longitudinal sections (a plurality of longitudinal sections having mutually different inclination angles with respect to the optical axis $AX_{Lo}$) between the B1-B1 cross-section and the C1-C1 cross-section is also adjusted (set) so that when the horizontal ray group included in each of the plurality of longitudinal sections enters the rear lens unit 31 through the front lens body 20, the horizontal ray group is condensed and forms a condensed point (group) in a vicinity of the reference axis AX2 (not shown).

By adjusting the curvature like this, the condensed point group, such as CP2C, forms the focal line FL2R which extends in the vehicle width direction along the reference axis AX2, as indicated by the solid line on the right side of the optical axis $AX_{Lo}$ in FIG. 4.

The focal lines FL2L and FL2R formed like this may not perfectly match with the reference axis AX2, as long as the focal lines FL2L and FL2R are disposed along the reference axis AX2.

The optical path of the light coming from the light source 40, which passes in the vicinity of the focal lines FL2L and FL2R (edge 31*c* disposed along the focal line FL2L and FL2R) formed as mentioned above, will be described next with reference to FIGS. 10A to 10C.

Figure 10A:
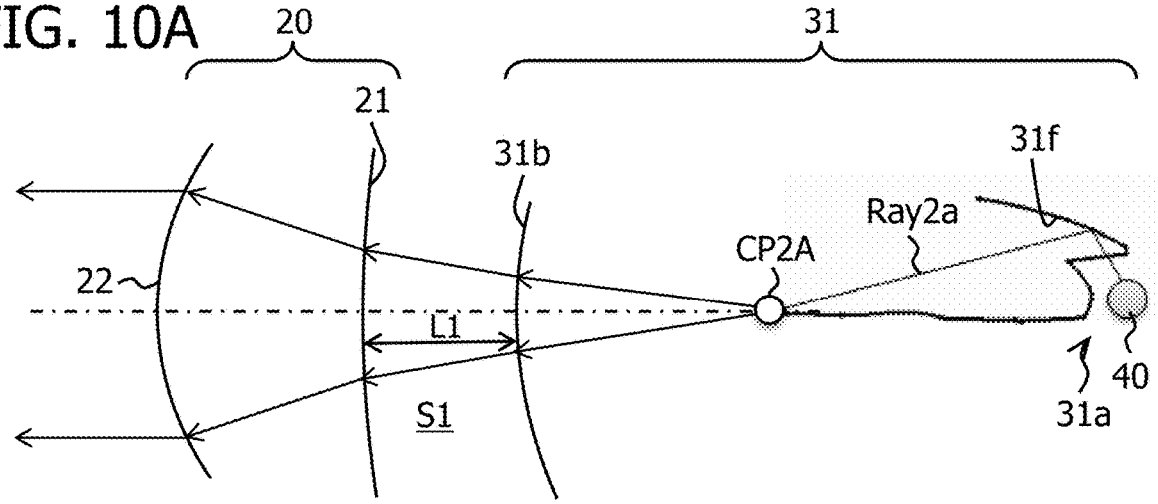
FIG. 10A indicates the A1-A1 cross-section (longitudinal section) in FIG. 4.

FIG. 10A indicates the A1-A1 cross-section (longitudinal section) in FIG. 4. In FIG. 10A, light Ray 2*a* from the light source 40, which passes through the A1-A1 cross-section of the rear lens unit 31, is illustrated.

As illustrated in FIG. 10A, in the A1-A1 cross-section, the light Ray 2*a* from the light source 40, which entered the rear lens unit 31 through the first entry surface 31*a* (peripheral entry surface 31*a*2), is internally reflected by the peripheral reflection surface 31*f*, and passes through the vicinity of the condensed point CP2A (focal line FL2L), passes through the vicinity of the condensed point CP2A at a relatively shallow angle (angle within a capture angle of the first exit surface 31*b*). Therefore the light Ray 2*a* exits through the first exit surface 31*b*, passes through the front lens body 20, and is irradiated forward, so as to form the low beam light distribution pattern.

This is the same for the light coming from the light source 40, which enters the rear lens unit 31 through the first entry surface 31*a* (peripheral entry surface 31*a*2), is internally reflected by the peripheral reflection surface 31*f*, and passes through the condensed point (focal line FL2L), in each of a plurality of longitudinal sections (a plurality of longitudinal sections having mutually different inclination angles with respect to the optical axis $AX_{Lo}$) between the A1-A1 cross-section and the B1-B1 cross-section, although this is not illustrated.

Figure 10B:
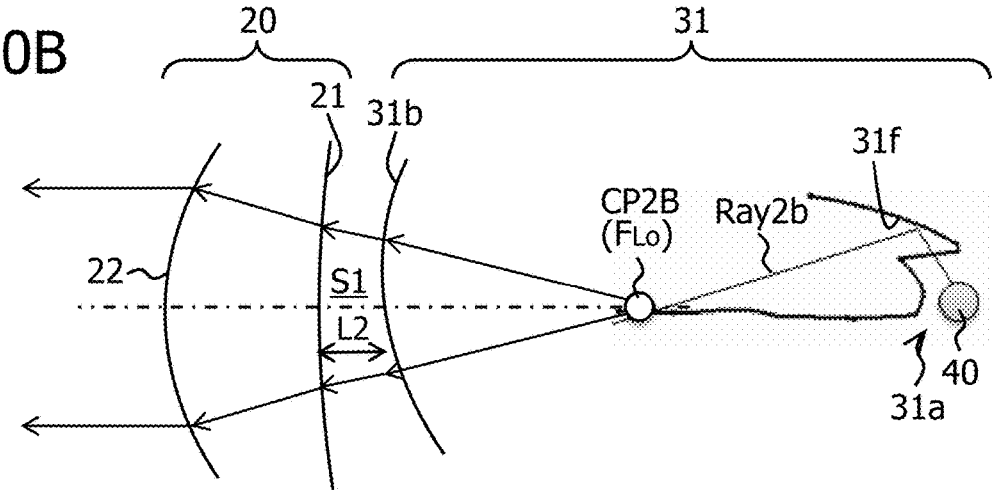
FIG. 10B is the B1-B1 cross-section (longitudinal section) in FIG. 4.

FIG. 10B is the B1-B1 cross-section (longitudinal section) in FIG. 4. In FIG. 10B, a light Ray 2*b* from the light source 40, that passes through the B1-B1 cross-section in the rear lens unit 31, is illustrated.

As illustrated in FIG. 10B, in the B1-B1 cross-section, the light Ray 2*b* from the light source 40, which entered the rear lens unit 31 through the first entry surface 31*a* (peripheral entry surface 31*a*2), is internally reflected by the peripheral reflection surface 31*f*, and passes through the vicinity of the condensed point CP2B (focal point $F_{Lo}$), passes through the vicinity of the condensed point CP2B (focal point $F_{Lo}$) at a relatively shallow angle (angle within a capture angle of the first exit surface 31*b*). Therefore the light Ray 2*b* exits through the first exit surface 31*b*, passes through the front lens body 20, and is irradiated forward, so as to form the low beam light distribution pattern.

Figure 10C:
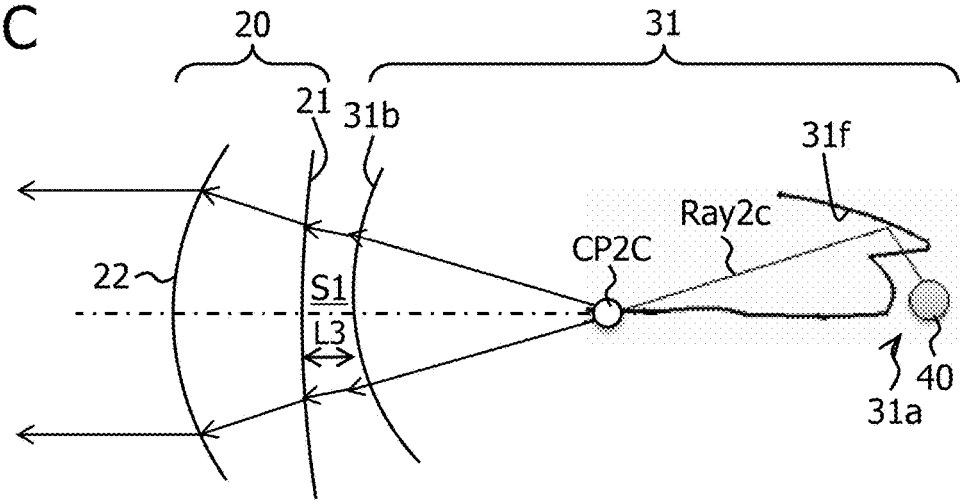
FIG. 10C is the C1-C1 cross-section (longitudinal section) in FIG. 4.

FIG. 10C is the C1-C1 cross-section (longitudinal section) in FIG. 4. In FIG. 10C, a light Ray 2*c* from the light source 40, that passes through the C1-C1 cross-section in the rear lens unit 31, is illustrated.

As illustrated in FIG. 10C, in the C1-C1 cross-section, the light Ray 2*c* from the light source 40, which entered the rear lens unit 31 through the first entry surface 31*a* (peripheral entry surface 31*a*2), is internally reflected by the peripheral reflection surface 31*f*, and passes through the vicinity of the condensed point CP2C (focal line FL2R), passes through the vicinity of the condensed point CP2C at a relatively shallow angle (angle within a capture angle of the first exit surface 31*b*), unlike FIG. 8C. Therefore the light Ray 2*c* exits through the first exit surface 31*b*, passes through the front lens body 20, and is irradiated forward, so as to form the low beam light distribution pattern.

This is the same for the light coming from the light source 40, which enters the rear lens unit 31 through the first entry surface 31*a* (peripheral entry surface 31*a*2), is internally reflected by the peripheral reflection surface 31*f*, and passes through the condensed point (focal line FL2R), in each of a plurality of longitudinal sections (a plurality of longitudinal sections having mutually different inclination angles with respect to the optical axis $AX_{Lo}$) between the B1-B1 cross-section and the C1-C1 cross-section, although this is not illustrated.

FIG. 5B is an example of the low beam light distribution pattern which is formed when the curvature of the first exit surface 31*b* in the longitudinal section is adjusted for each longitudinal section, as described above. FIG. 5B indicates an example of the low beam light distribution pattern, which is formed on a virtual vertical screen facing the front surface of the vehicle.

According to FIG. 5B, the luminous intensity near the cut-off area at 5 to 20° to the left is higher than the low beam light distribution pattern (low beam light distribution pattern which is formed when a curvature of the first exit surface 31*b* in the longitudinal section is the same in each longitudinal section), illustrated in FIG. 5A, for example, and the generation of a relative drop of the luminous intensity in a part of the low beam light distribution pattern (luminous intensity in a range enclosed by the square B2 in FIG. 5B) is suppressed.

This is because the light coming from the light source 40, such as Ray 2*c*, which passes through the vicinity of the focal line FL2R, passes through the vicinity of the edge 31*c* (focal line FL2R) at a relatively shallow angle (an angle within a capture angle of the first exit surface 31*b*), as illustrated in FIG. 10C. And as a result, the luminous intensity in a part of the low beam light distribution pattern (luminous intensity in a range enclosed by the square B2 in FIG. 5B) increases as illustrated in FIG. 5B.

As described above, according to this embodiment, a vehicular lamp fitting 10 which suppresses the generation of a relative drop of the luminous intensity in a part of the low beam light distribution pattern (generation of a blurred state), is provided, even if the front lens body 20 is disposed in an attitude that is inclined at a predetermined receding angle θ1, as illustrated in FIG. 1.

This is because the curvature of the first exit surface 31*b* in a longitudinal section is different in each longitudinal section (see FIG. 10).

In concrete terms, this is because the curvature of the first exit surface 31*b* in the longitudinal section is adjusted (set) for each longitudinal section, so that when the horizontal ray group included in each of a plurality of longitudinal sections (vertical surfaces) having mutually different inclination angles with respect to the optical axis $AX_{Lo}$ enters the rear lens unit 31 through the front lens body 20 from the front side of the front lens body 20, the horizontal ray group is condensed and forms two focal lines FL2L and FL2R (condensed point group) along the reference axis AX2, in the vicinity of the reference axis AX2.

In other words, the curvature of the first exit surface 31*b* in the longitudinal cross-section is adjusted for each longitudinal section, so as to be larger as the distance decreases between the second entry surface 21 and the first exit surface 31*b*, where the horizontal ray group included in each of the plurality of vertical surfaces having mutually different inclination angles with respect to the optical axis $AX_{Lo}$, passes (see FIG. 10A to FIG. 10C).

Further, the first exit surface 31*b* is not only a curved surface which mainly condenses light in the first direction, but also has a curved surface (curved surface in the longitudinal direction) which has a condensing function in the second direction, and this curved surface in the longitudinal direction is adjusted (set) so that the curvature increases in the declining direction of the front lens (right to left in FIG. 4).

The first exit surface 31*b* may be a freeform surface. For example, the first exit surface 31*b* may be a freeform surface of which surface shape is adjusted (set) so that when the horizontal ray group included in each of a plurality of longitudinal sections (vertical surfaces) having mutually different inclination angles with respect to the optical axis $AX_{Lo}$ (hereafter horizontal ray group A) enters the rear lens unit 31 through the front lens body 20 from the front side of the front lens body 20, the horizontal ray group is condensed and forms the focal lines FL2L and FL2R (condensed point group) along the reference axis AX2 in the vicinity of the reference axis AX2.

The first exit surface 31*b* (freeform surface) is configured, for example, as follows. For example, the first exit surface 31*b* can be configured by changing (adjusting) the surface shape of a reference surface (a surface to be a base of the first exit surface 31*b*, such as a curved surface that is convex in the forward direction) using a predetermined simulation software, so that the horizontal ray group A, which entered the rear lens unit 31 through the front lens body 20 (in the sequence of the second exit surface 22, the second entry surface 21 and the first exit surface 31*b*) from the front side of the front lens body 20, is condensed in the vicinity of the reference axis AX2, and forms the focal lines FL2L and FL2R (condensed point group) along the reference axis AX2.

Thereby the generation of the relative drop of the luminous intensity in a part of the low beam light distribution pattern is suppressed, even if the front lens body 20 is disposed in an attitude inclined at a predetermined receding angle θ1, as illustrated in FIG. 1.

Further, according to Embodiment 1, both the second entry surface 21 and the second exit surface 22 are configured as cylindrical surfaces, which are convex in the forward direction and of which cylindrical axes extend in the first direction (see FIG. 3), in other words, not only the second exit surface 22 but also the second entry surface 21 can condense the light in the second direction. Hence, compared with the case of the above mentioned prior art, where the second entry surface is a plane and only the second exit surface condenses light in the second direction, the thickness of the front lens body 20 in the optical axis $AX_{Lo}$ direction can be decreased while maintaining the condensing rate. As a consequence, the material cost of the front lens body 20 can be reduced (cost reduction).

A modification will be described next.

In Embodiment 1, an example of suppressing the generation of a relative drop of luminous intensity in a part of the low beam light distribution pattern by making the curvature of the first exit surface 31*b* in the longitudinal section different for each longitudinal section was described, but the present invention is not limited to this.

For example, the curvature of the first exit surface 31*b* in the longitudinal section may be the same in each longitudinal section, and the curvature of the second entry surface 21 in the longitudinal section may be different for each longitudinal section.

For example, the curvature of the second entry surface 21 in the longitudinal section is adjusted (set) for each longitudinal section, so that when the horizontal ray group included in each of a plurality of longitudinal sections enters the rear lens unit 31 through the front lens body 20, the horizontal ray group condenses and forms the condensed point (group) in the vicinity of the reference axis AX2.

In other words, the curvature of the second entry surface 21 in the longitudinal cross-section is adjusted for each longitudinal section, so as to be larger as the distance between the second entry surface 21 and the first exit surface 31*b*, where the horizontal ray group included in each of the plurality of vertical surfaces having mutually different inclination angles with respect to the optical axis $AX_{Lo}$, passes, is shorter.

The second entry surface 21 includes a curved surface (curved surface in the longitudinal direction) which has a function to condense the light in the second direction, and the curved surface in the longitudinal direction is adjusted (set) such that the curvature or the condensing power increases in the declining direction of the front lens (right to left in FIG. 4).

The second entry surface 21 may be a freeform surface, such like the first exit surface 31*b*.

This configuration also suppresses the generation of the relative drop of luminous intensity in a part of the low beam light distribution pattern.

Further, along with the curvature (or condensing power) of the longitudinal section of the first exit surface 31*b*, the curvature (or condensing power) of the longitudinal section of the second entry surface 21 may be different in each longitudinal section. For example, in the case where the horizontal ray group included in each of the plurality of longitudinal sections enters the rear lens unit 31 through the front lens body 20, the curvatures of the first exit surface 31*b* and the second entry surface 21 of the longitudinal sections are adjusted (set) for each longitudinal section, so that the horizontal ray group is condensed and forms a condensed point (group) in the vicinity of the reference axis AX2. This configuration also suppresses the generation of the relative drop of luminous intensity in a part of the low beam light distribution pattern.

Embodiment 2

Figure 11:
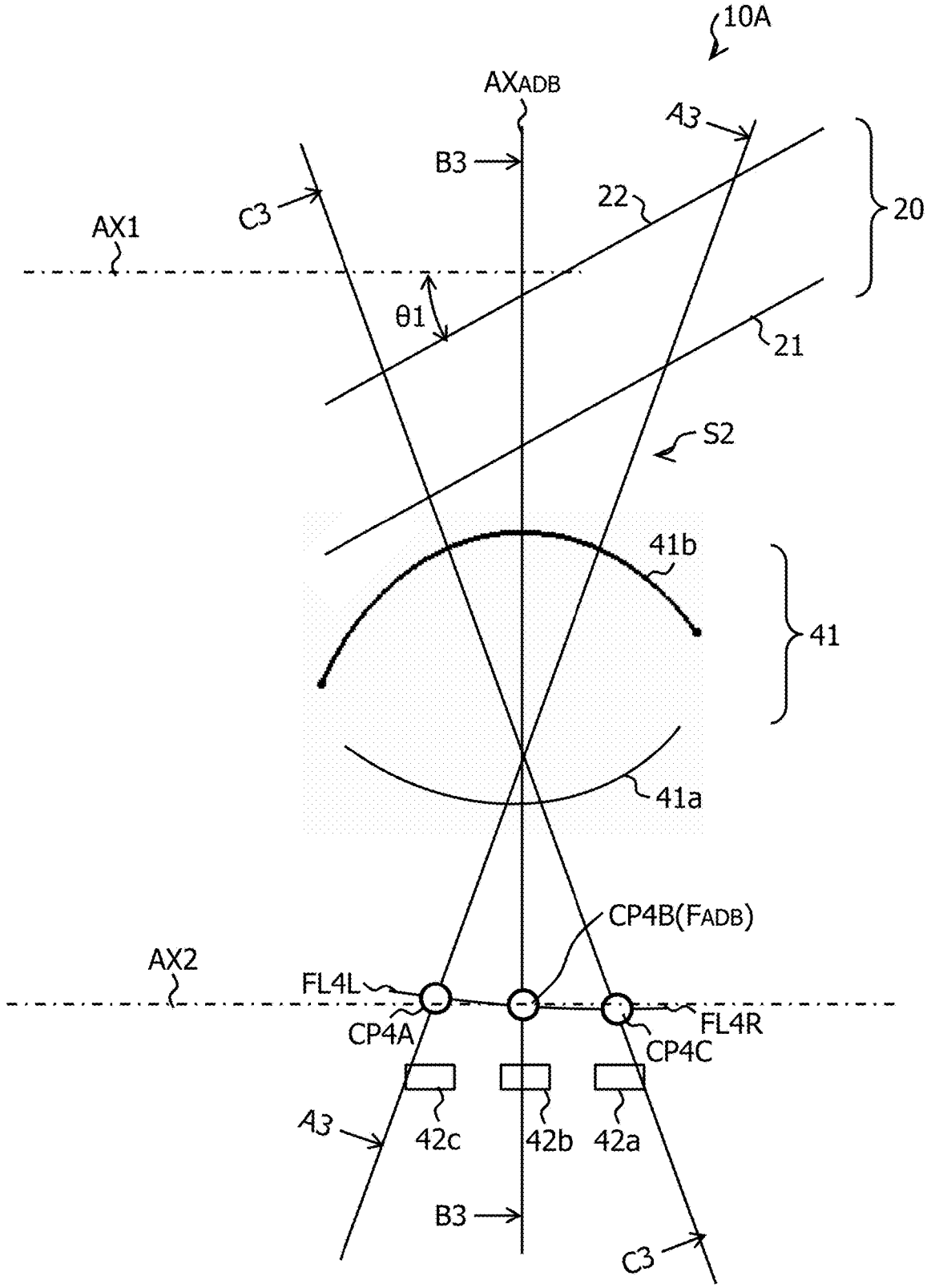
FIG. 11 is a top view of the vehicular lamp fitting 10A (portions other than the major optical surface are omitted)

Next as Embodiment 2, a vehicular lamp fitting 10A which includes: a rear lens unit 41 instead of the rear lens unit 31; and a plurality of light sources 42*a* to 42*c* instead of the light source 40, will be described with reference to FIG. 11. The other configurations are the same as those in Embodiment 1. In the following, the primary differences from Embodiment 1 will be described, and a composing element the same as Embodiment 1 is denoted with a same reference symbol, and description thereof may be omitted. FIG. 11 is a lateral sectional view of the vehicular lamp fitting 10A of Embodiment 2 (portions other than the major optical surface are omitted).

As illustrated in FIG. 11, the vehicular lamp fitting 10A is a vehicular lamp fitting configured to form an ADB light distribution pattern, and includes: a front lens body 20; a rear lens unit 41 disposed behind the front lens body 20; and a plurality of light sources 42*a* to 42*c*, that are disposed behind the rear lens unit 41, and that emit respective light which passes through the rear lens unit 41 and the front lens body 20 in this order, and is irradiated forward, so as to form an ADB light distribution pattern. A plurality of rear lens unit 41 and a plurality of light sources 42*a* to 42*c* may be used.

The front lens body 20 and the rear lens unit 41 are made of transparent resin such as acrylic and polycarbonate. The front lens body 20 and the rear lens unit 41 are separately molded in a physically separated state by injection molding. The front lens body 20 and the rear lens unit 41 are configured as a lens body connected by a holding member (not shown) such as a lens holder.

Figure 12A:
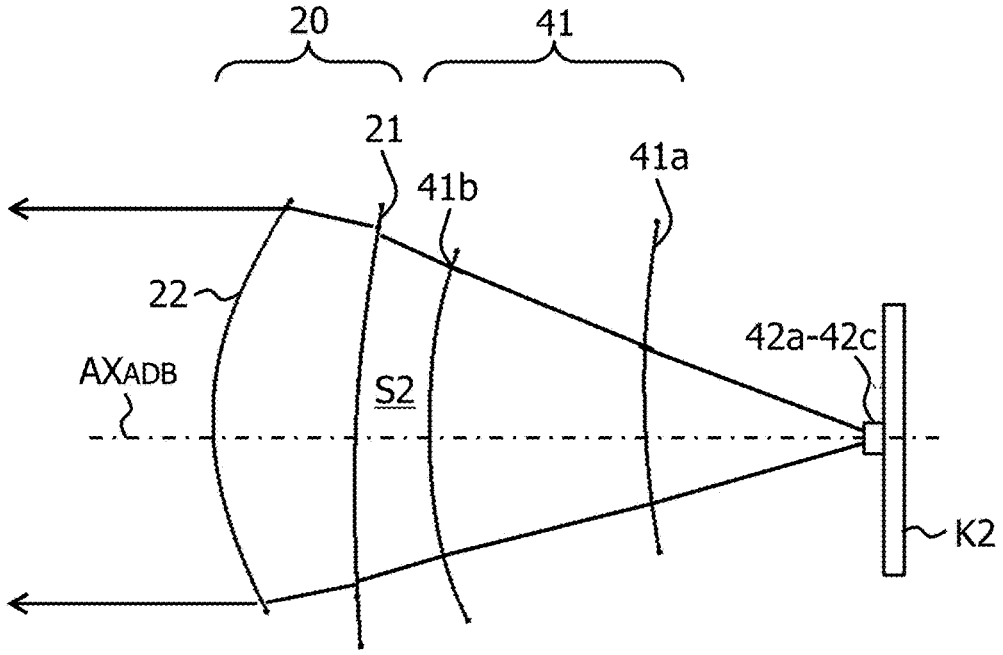
FIG. 12A is a B3-B3 sectional view of the vehicular lamp fitting 10A illustrated in FIG. 11 (portions other than the major optical surface are omitted)

FIG. 12A is a B3-B3 sectional view of the vehicular lamp fitting 10A illustrated in FIG. 11 (portions other than the major optical surface are omitted). In FIG. 11, FIG. 12A and the like, the line extending in the vehicle length direction, indicated by the reference symbol $AX_{ADB}$, is an optical axis of a projection lens, which is configured by the front lens body 20 and the rear lens unit 41. The optical axis is hereafter referred to as the optical axis $AX_{ADB}$.

Figure 12B:
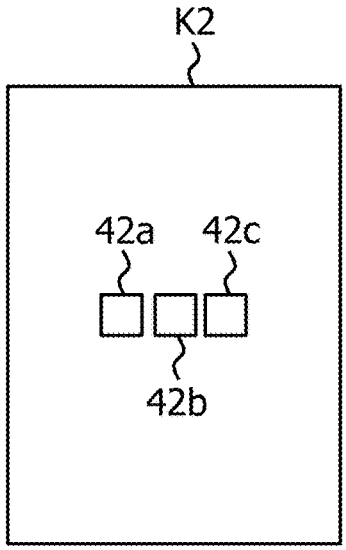
FIG. 12B is a front view of a substrate K2.

FIG. 12B is a front view of a substrate K2 on which the light sources 42*a* to 42*c* are mounted.

As illustrated in FIG. 12B, the light source 42*a* to 42*c* are semiconductor light emitting element such as an LED or LD having a rectangular (for example, a 1 $mm^2$) light emitting surface and are mounted to a substrate K2 with the light emitting surface facing forward (to the front). The light sources 42*a* to 42*c* are arranged in a line in the horizontal direction. The substrate K2 is mounted to the housing (not shown) using a screw or another means.

As illustrated in FIG. 12B, the rear lens unit 41 includes a first entry surface 41*a*, and a first exit surface 41*b* on the side opposite to the first entry surface 41*a*. The rear lens unit 41 is mainly responsible for condensing the light from the light sources 42*a* to 42*c* passing through the rear lens unit 41 in the first direction.

The first entry surface 41*a* is a surface through which the respective light coming from the light sources 42*a* to 42*c* enters the rear lens unit 41. The first entry surface 41*a* is configured as a curved surface which is convex in the forward direction. The curvature of the first entry surface 41*a* in the longitudinal section is the same in each longitudinal section, and the curvature of the first entry surface 41*a* in the lateral section is the same in each lateral section.

The first exit surface 41*b* is a surface through which the respective light coming from the light sources 42*a* to 42*c*, which entered the rear lens unit 41 through the first entry surface 41*a*, exits.

As illustrated in FIG. 11, the first exit surface 41*b* is configured as a curved surface that is convex in the forward direction in the lateral section. The curvature of the first exit surface 41*b* is the same in each lateral section. On the other hand, the curvature of the first exit surface 41*b* is not the same in each longitudinal section, but is different in each longitudinal section. For example, the curvature of the first exit surface 41*b* in the longitudinal section is different in the A3-A3 cross-section, B3-B3 cross section, and C3-C3 cross section respectively in FIG. 11. It will be described later how the curvature of the longitudinal cross section of the first exit surface 41*b* differs in each longitudinal cross section.

The light sources 42*a* to 42*c* are disposed along the focal line, as mentioned later.

Figure 14:
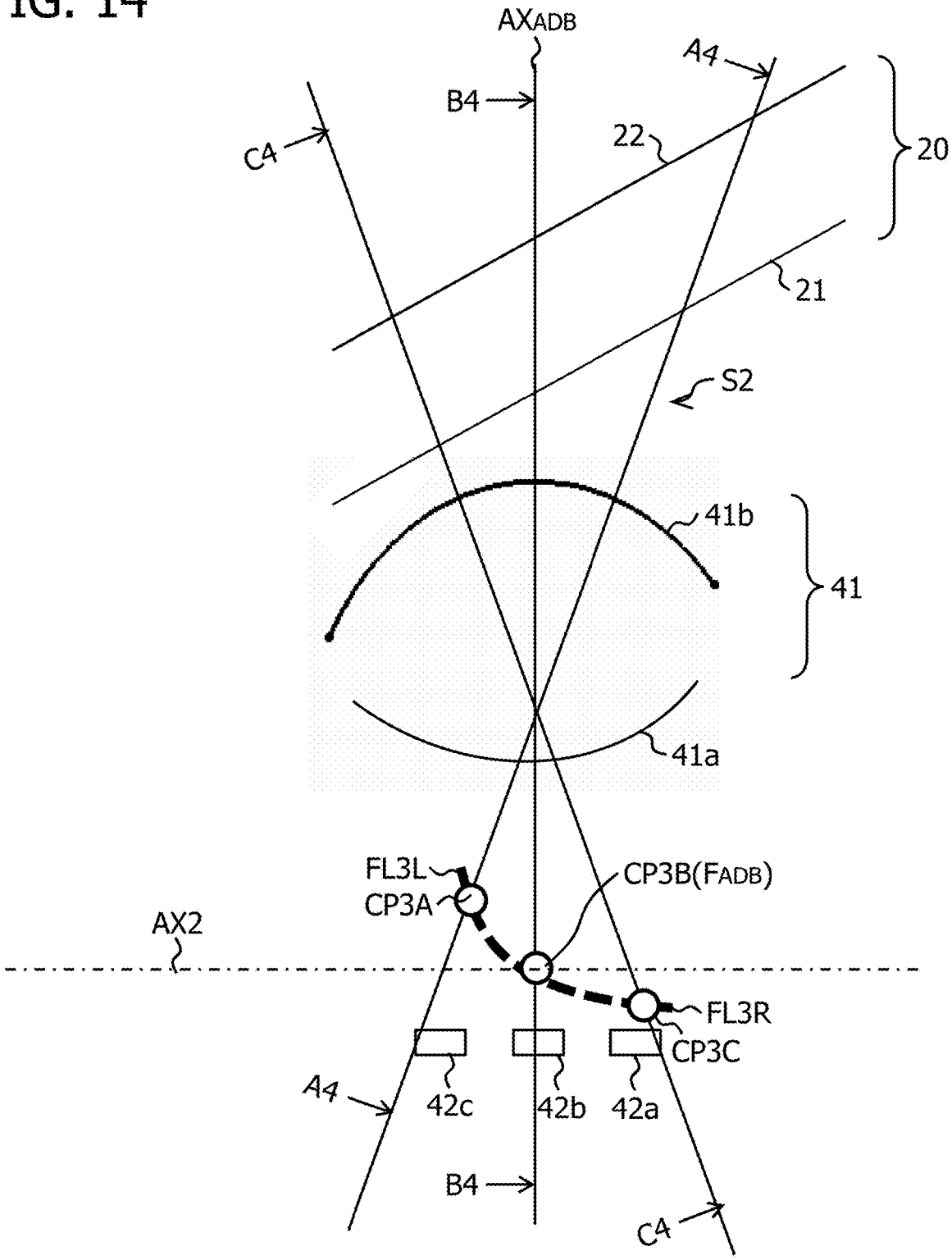
FIG. 14 is a lateral sectional view of the vehicular lamp fitting 10A (portions other than the major optical surface are omitted)
Figure 15:
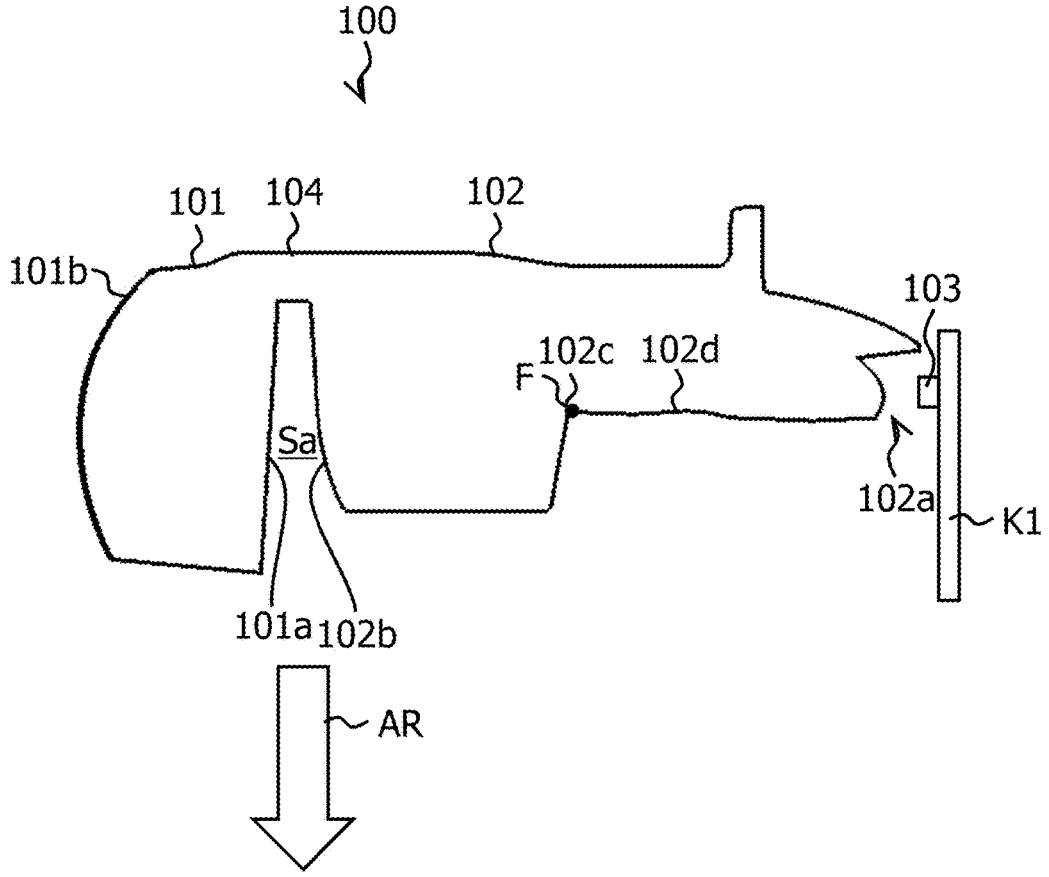
FIG. 15 is a longitudinal sectional view of a conventional vehicular lamp fitting 100.
Figure 16:
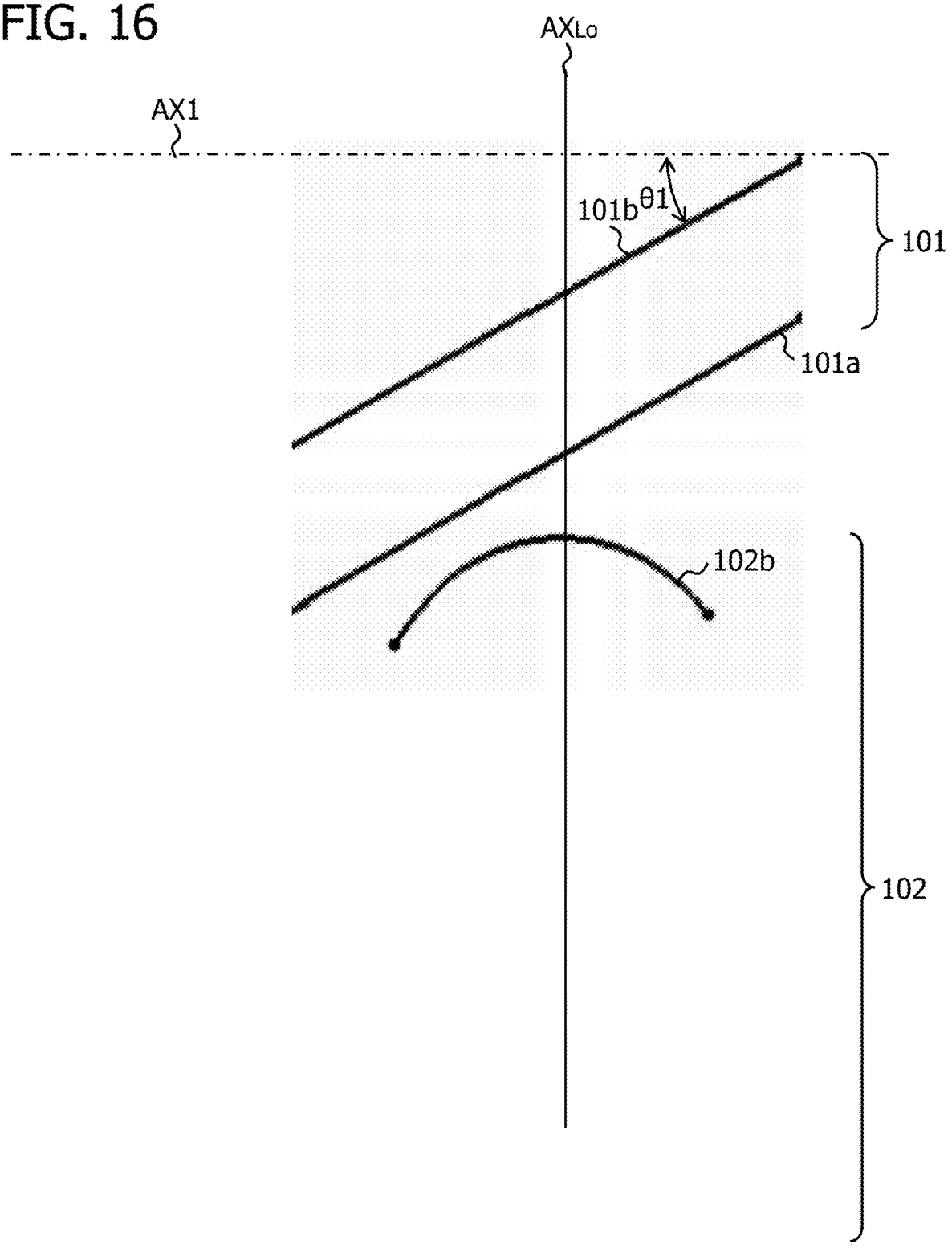
FIG. 16 is a lateral sectional view of the vehicular lamp fitting 100 illustrated in FIG. 15 (portions other than the major optical surface are omitted).

The focal line is a group of condensed points which are formed behind the rear lens unit 41, when a plurality of horizontal rays, which are included in a plurality of vertical surfaces having mutually different inclination angles with respect to the optical axis $AX_{ADB}$ respectively, passes through the front lens body 20 and the rear lens unit 41 from the front side of the front lens body 20. The solid lines indicated by the reference symbols FL4L and FL4R in FIG. 11 and the dotted lines indicated by the reference symbols FL3L and FL3R in FIG. 14 are examples of the focal line. These lines are hereafter referred to as the focal line FL3L, focal line FL3R, focal line FL4L and focal line FL4R. The focal lines FL3L, FL3R, FL4L and FL4R will be described in detail later.

In the vehicular lamp fitting 10A having the above-described configuration, when the light sources 42*a* to 42*c* are turned on, the light from the light sources 42*a* to 42*c* enters the rear lens units 41 from the first entry surface 41*a* and exits from the first exit surface 41*b*. At this time, the first exit surface 41*b* (lateral section of the first exit surface 41*b*) acts to condense, in the first direction, the light from the light source 42*a* to 42*c* which exits the first exit surface 41*b*. Then, the light from the light source 42*a* to 42*c* which has exited the first exit surface 41*b* passes through a space S2 between the rear lens unit 41 and the front lens body 20, further enters the front lens body 20 from the second entry surface 21 and is irradiated forward after exiting the second exit surface 22. At this time, the second exit surface 22 acts to condense, in the second direction, the light from the light source 42*a* to 42*c* which exit the second exit surface 22. Thereby, the ADB light distribution pattern is formed.

In other words, the light source images of the light sources 42*a* to 42*c* are inverted and projected forward by the rear lens unit 41 and the front lens body 20, which function as the projection lens. Thereby the ADB light distribution pattern is formed.

An ADB light distribution pattern which is formed when a curvature of the first exit surface 41*b* in the longitudinal section is the same in each longitudinal section will be described next.

Figure 13:
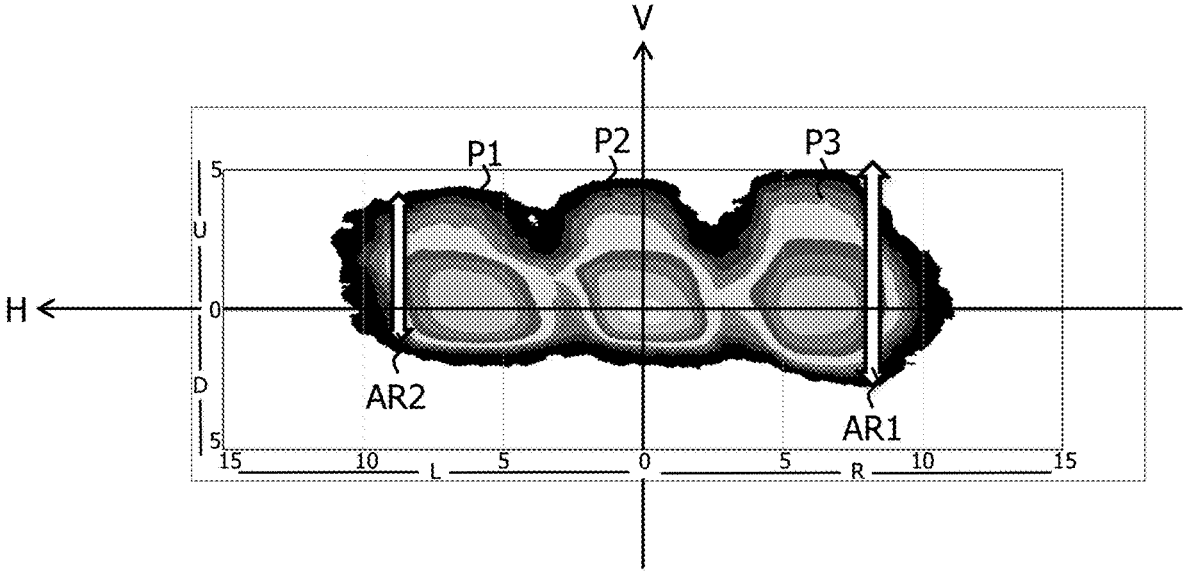
FIG. 13 is an example of the ADB light distribution pattern which is formed when a curvature of the first exit surface 41*b* in the longitudinal section is the same in each longitudinal section.

FIG. 13 is an example of the ADB light distribution pattern which is formed when a curvature of the first exit surface 41*b* in the longitudinal section is the same in each longitudinal section. FIG. 13 indicates an example of the ADB light distribution pattern which is formed on a virtual vertical screen facing the front surface of the vehicle.

As illustrated in FIG. 13, the ADB light distribution pattern includes a plurality of irradiation regions P1 to P3 which are horizontally disposed on a line in the high beam region. The irradiation regions P1 to P3 are independently turned ON/OFF (including lighting in the dimmed state) in accordance with the turning ON/OFF of the light sources 42*a* to 42*c* (including lighting in the dimmed state). FIG. 13 indicates an example of the ADB light distribution pattern which is formed in the state that the light sources 42*a* to 42*c* are lit (fully lit) respectively.

The present inventors performed simulation and confirmed that a part of the ADB light distribution pattern is stretched longitudinally and a relative drop of the luminous intensity in a part of the ADB light distribution pattern is generated (a blurred state is generated) when the front lens body 20 is disposed in an attitude that is inclined with respect to the reference axis AX1 at a receding angle θ1, when viewed from the top, if the curvature of the first exit surface 41*b* in the longitudinal section is the same in each longitudinal section, as illustrated in FIG. 11.

According to FIG. 13, a part of the ADB light distribution pattern (the portion indicated by the arrow mark AR1) is stretched more than the portion indicated by the arrow mark AR2 in the longitudinal direction, and the luminous intensity in this part has relatively dropped. The reason for the generation of this drop of luminous intensity in a part of the ADB light distribution pattern is the same as that described in Embodiment 1 with reference to FIG. 8C. This reason will be described in brief next.

First the focal line that is formed when the curvature of the first exit surface 41*b* in the longitudinal section is the same in each longitudinal section will be described with reference to FIG. 14.

FIG. 14 is a lateral sectional view of the vehicular lamp fitting 10A (portions other than the major optical surface are omitted). In FIG. 14, the focal lines FL3L and FL3R, which are formed when the curvature of the first exit surface 41*b* in the longitudinal section is the same in each longitudinal section, are indicated.

When the horizontal ray group included in the A4-A4 cross-section in FIG. 14 passes through the front lens body 20 and the rear lens unit 41, the horizontal ray group condenses at a point behind the rear lens unit 41 and ahead of the focal point $F_{ADB}$, and forms a condensed point CP3A.

The focal point $F_{ADB}$ is a condensed point on the optical axis $AX_{ADB}$ behind the rear lens unit 41, when the horizontal ray group, which is parallel with the optical axis $AX_{Lo}$, enters the rear lens unit 41 through the front lens body 20 from the front side of the front lens body 20.

In the same manner, as shown in FIG. 14, when the horizontal ray group included in each of the plurality of longitudinal sections (a plurality of longitudinal sections having mutually different inclination angles with respect to the optical axis $AX_{ADB}$) between the A4-A4 cross-section and the B4-B4 cross section, passes through the front lens body 20 and the rear lens unit 41 as well, the horizontal ray group condenses at a point behind the rear lens unit 41 and ahead of the focal point $F_{ADB}$, and forms a condensed point (group), although this is not illustrated.

The condensed point group, such as CP3A, formed by being condensed at a point behind the rear lens unit 41 and ahead of the focal point $F_{ADB}$ like this, constitutes a focal line FL3L, as indicated by the dotted line on the left side of the optical axis $AX_{ADB}$ in FIG. 14.

When the horizontal ray group included in the B4-B4 cross-section in FIG. 14 passes through the front lens body 20 and the rear lens unit 41, the horizontal ray group condenses at the focal point $F_{ADB}$ behind the rear lens unit 41 and forms a condensed point CP3B.

When the horizontal ray group included in the C4-C4 cross-section in FIG. 14 passes through the front lens body 20 and the rear lens unit 41, the horizontal ray group condenses behind the rear lens unit 41 and the focal point $F_{ADB}$, and forms a condensed point CP3C.

In the same manner, as shown in FIG. 14, when the horizontal ray group included in each of the plurality of longitudinal sections (a plurality of longitudinal sections having mutually different inclination angles with respect to the optical axis $AX_{ADB}$) between the B4-B4 cross-section and the C4-C4 cross section, passes through the front lens body 20 and the rear lens unit 41 as well, the horizontal ray group condenses behind the rear lens unit 41 and the focal point $F_{ADB}$, and forms a condensed point (group), although this is not illustrated.

The condensed point group, such as CP3C, formed by being condensed at a point behind the rear lens unit 41 and behind the focal point $F_{ADB}$ like this, constitutes a focal line FL3R, as indicated by the dotted line on the right side of the optical axis $AX_{ADB}$ in FIG. 14.

The focal line FL3L and the focal line FL3R are laterally asymmetric with respect to the optical axis $AX_{ADB}$ in FIG. 14. This is because the distance between the second entry surface 21 and the first exit surface 41*b* through which each horizontal ray group passes is different depending on the horizontal ray group.

When the light sources 42*a* to 42*c* are disposed with respect to the focal line FL3L and FL3R configured like this (see FIG. 14), the distance between the light sources 42*a* to 42*c* and the focal lines FL3L and FL3R changes depending on each light source 42*a* to 42*c*. For example, the distance between the light source 42*a* and the condensed point CP3C (focal line FL3R) is the shortest, and the distance between the light source 42*c* and the condensed point CP3A (focal line FL3L) is the longest. As a result, a part of the ADB light distribution pattern (the portion indicated by the arrow mark AR1 in FIG. 13) is stretched in the longitudinal direction, and a drop of the luminous intensity is generated (a blurred state is generated).

A configuration for suppressing that a part of ADB light distribution pattern is extended in the longitudinal direction and the light intensity decreases relatively will be described next.

As a result of intensive studies to suppress the generation of the relative drop of the luminous intensity in a part of the ADB light distribution pattern, the present inventors discovered that the generation of the relative drop of the luminous intensity in a part of the ADB light distribution pattern can be suppressed by adjusting the curvature of the first exit surface 41*b* in the longitudinal section for each longitudinal section.

This adjustment is an adjustment for correcting the focal lines FL3L and FL3R shown in FIG. 14 into focal lines (e.g. focal lines FL4L and FL4R shown in FIG. 11) extending in the vehicle width direction. This adjustment is performed using a predetermined simulation software.

The focal lines that are generated after adjusting the curvature of the first exit surface 41*b* in the longitudinal section for each longitudinal section will be described next with reference to FIG. 11.

In FIG. 11, the curvature of the first exit surface 41*b* in the A3-A3 cross-section is adjusted (set) to a first curvature, so that when the horizontal ray group included in the A3-A3 cross-section passes through the front lens body 20 and the rear lens unit 41, the horizontal ray group is condensed behind the rear lens unit 41 and forms a condensed point CP4A in the vicinity of the reference axis AX2.

In the same manner, the curvature of each of a plurality of longitudinal sections (a plurality of longitudinal sections having mutually different inclination angles with respect to the optical axis $AX_{ADB}$) between the A3-A3 cross-section and the B3-B3 cross-section is also adjusted (set) so that when the horizontal ray group included in each of the plurality of longitudinal sections passes through the front lens body 20 and the rear lens unit 41, the horizontal ray group is condensed behind the rear lens unit 41 and forms a condensed point (group) in a vicinity of the reference axis AX2.

By adjusting the curvature like this, the condensed point group, such as CP4A, forms the focal line FL4L which extends in the vehicle width direction along the reference axis AX2, as indicated by the solid line on the left side of the optical axis $AX_{ADB}$ in FIG. 11.

In FIG. 11, the curvature of the first exit surface 41*b* in the B3-B3 cross-section is adjusted (set) to a second curvature (the second curvature>the first curvature), so that when the horizontal ray group included in the B3-B3 cross-section passes through the front lens body 20 and the rear lens unit 41, the horizontal ray group is condensed behind the rear lens unit 41 and forms a condensed point CP4B in the vicinity of the reference axis AX2.

In FIG. 11, the curvature of the first exit surface 41*b* in the C3-C3 cross-section is adjusted (set) to a third curvature (the third curvature>the second curvature), so that when the horizontal ray group included in the C3-C3 cross-section passes through the front lens body 20 and the rear lens unit 41, the horizontal ray group is condensed behind the rear lens unit 41 and forms a condensed point CP4C in the vicinity of the reference axis AX2.

In the same manner, the curvature of each of a plurality of longitudinal sections (a plurality of longitudinal sections having mutually different inclination angles with respect to the optical axis $AX_{ADB}$) between the B3-B3 cross-section and the C3-C3 cross-section is also adjusted (set) so that when the horizontal ray group included in each of the plurality of longitudinal sections passes through the front lens body 20 and the rear lens unit 41, the horizontal ray group is condensed behind the rear lens unit 41 and forms a condensed point (group) in a vicinity of the reference axis AX2.

By adjusting the curvature like this, the condensed point group, such as CP4C, forms the focal line FL4R which extends in the vehicle width direction along the reference axis AX2, as indicated by the solid line on the right side of the optical axis $AX_{ADB}$ in FIG. 11.

When the light sources 42*a* to 42*c* are disposed with respect to the focal line FL4L and FL4R configured like this (see FIG. 11), the distance between the light sources 42*a* to 42*c* and the focal lines FL4L and FL4R does not change depending on each light source 42*a* to 42*c* and is substantially the same. As a result, it is suppressed that a part of the ADB light distribution pattern (the part indicated by the arrow AR1 in FIG. 13) is extended in the longitudinal direction and the light intensity decreases relatively (a blurred state is generated).

As described above, according to this embodiment, as shown in FIG. 11, a vehicular lamp fitting 10A, which suppresses the generation of a relative drop of the luminous intensity in a part of the ADB light distribution pattern (generation of a blurred state), can be provided, even if the front lens body 20 is disposed in an attitude that is inclined at a predetermined receding angle θ1.

This is because, as in the first embodiment (see FIG. 9), the curvature of the first exit surface 41*b* in a longitudinal section is different in each longitudinal section.

In concrete terms, this is because the curvature of the first exit surface 31*b* in the longitudinal section is adjusted (set) for each longitudinal section, so that when the horizontal ray group included in each of a plurality of longitudinal sections (vertical surfaces) having mutually different inclination angles with respect to the optical axis $AX_{Lo}$ passes through the front lens body 20 and the rear lens unit 41, the horizontal ray group is condensed behind the rear lens unit 41 and forms two focal lines FL4L and FL4R (condensed point group) along the reference axis AX2.

In other words, the curvature of the first exit surface 41*b* in the longitudinal cross-section is adjusted for each longitudinal section, so as to be larger as the distance decreases between the second entry surface 21 and the first exit surface 41*b*, where the horizontal ray group included in each of the plurality of vertical surfaces having mutually different inclination angles with respect to the optical axis $AX_{ADB}$, passes.

Further, the first exit surface 41*b* is not only a curved surface which mainly condenses light in the first direction, but also has a curved surface (curved surface in the longitudinal direction) which has a condensing function in the second direction, and this curved surface in the longitudinal direction is adjusted (set) so that the curvature increases in the declining direction of the front lens.

The first exit surface 41*b* may be a freeform surface. For example, the first exit surface 41*b* may be a freeform surface of which surface shape is adjusted (set) so that when the horizontal ray group included in each of a plurality of longitudinal sections (vertical surfaces) having mutually different inclination angles with respect to the optical axis $AX_{ADB}$ (hereafter horizontal ray group B) enters the rear lens unit 41 through the front lens body 20 from the front side of the front lens body 20, the horizontal ray group is condensed and forms the focal lines FL4L and FL4R (condensed point group) along the reference axis AX2 in the vicinity of the reference axis AX2.

The first exit surface 41*b* (freeform surface) is configured, for example, as follows. For example, the first exit surface 41*b* can be configured by changing (adjusting) the surface shape of a reference surface (a surface to be a base of the first exit surface 41*b*, such as a curved surface that is convex in the forward direction) using a predetermined simulation software, so that the horizontal ray group B, which entered the rear lens unit 41 through the front lens body 20 (in the sequence of the second exit surface 22, the second entry surface 21 and the first exit surface 41*b*) from the front side of the front lens body 20, is condensed in the vicinity of the reference axis AX2, and forms the focal lines FL4L and FL4R (condensed point group) along the reference axis AX2.

Thereby the generation of the relative drop of the luminous intensity in a part of the ADB light distribution pattern is suppressed, even if the front lens body 20 is disposed in an attitude inclined at a predetermined receding angle θ1, as illustrated in FIG. 11.

Further, according to Embodiment 2, both the second entry surface 21 and the second exit surface 22 are configured as cylindrical surfaces, which are convex in the forward direction and of which cylindrical axes extend in the first direction (see FIG. 3), in other words, not only the second exit surface 22 but also the second entry surface 21 can condense the light in the second direction. Hence, compared with the case of the above mentioned prior art, where the second entry surface is a plane and only the second exit surface condenses light in the second direction, the thickness of the front lens body 20 in the optical axis $AX_{ADB}$ direction can be decreased while maintaining the condensing rate. As a consequence, the material cost of the front lens body 20 can be reduced (cost reduction).

A modification will be described next.

In Embodiment 2, an example of suppressing the generation of a relative drop of luminous intensity in a part of the ADB light distribution pattern by making the curvature of the first exit surface 41*b* in the longitudinal section different for each longitudinal section was described, but the present invention is not limited to this.

For example, the curvature of the first exit surface 41*b* in the longitudinal section may be the same in each longitudinal section, and the curvature of the longitudinal section of at least one of the first entry surface 41*a* and the second entry surface 21 may be different for each longitudinal section.

For example, the curvature of each of a plurality of longitudinal sections of the second entry surface 21 (or the first entry surface 41*a*) is adjusted (set) so that when the horizontal ray group included in each of the plurality of longitudinal sections passes through the front lens body 20 and the rear lens unit 41, the horizontal ray group is condensed behind the rear lens unit 41 and forms a condensed point (group) in a vicinity of the reference axis AX2. This also makes it possible to suppress a relative decrease in the light intensity of a part of the ADB light distribution pattern.

In other words, the curvature of the second entry surface 21 (or the first entry surface 41*a*) in the longitudinal cross-section is adjusted for each longitudinal section, so as to be larger as the distance between the second entry surface 21 and the first exit surface 41*b*, where the horizontal ray group included in each of the plurality of vertical surfaces having mutually different inclination angles with respect to the optical axis $AX_{ADB}$, passes, is shorter.

The second entry surface 21 (or the first entry surface 41*a*) includes a curved surface (curved surface in the longitudinal direction) which has a function to condense the light in the second direction. The curved surface in the longitudinal direction of the second entry surface 21 is adjusted (set) such that the curvature or the condensing power increases in the declining direction of the front lens (right to left in FIG. 4). The curved surface in the longitudinal direction of the first entry surface 41*a* is adjusted (set) such that the curvature or the condensing power decreases in the declining direction of the front lens.

The second entry surface 21 (or the first entry surface 41*a*) may be a freeform surface, such like the first exit surface 41*b*.

Also, for example, the curvature of at least one of the longitudinal sections of the first entry surface 41*a* and the second entry surface 21 may be made different for each of the longitudinal sections together with the curvature of the longitudinal section of the first exit surface 41*b*. For example, the curvature of each of a plurality of longitudinal sections of the first exit surface 41*b* and the second entry surface 21 are adjusted (set) so that when the horizontal ray group included in each of the plurality of longitudinal sections passes through the front lens body 20 and the rear lens unit 41, the horizontal ray group is condensed behind the rear lens unit 41 and forms a condensed point (group) in a vicinity of the reference axis AX2. This also makes it possible to suppress a relative decrease in the light intensity of a part of the ADB light distribution pattern.

Embodiment 3

A vehicular lamp fitting 10B according to Embodiment 3 of the present invention will be described below with reference to the attached drawings. In each drawing, a corresponding composing element is denoted with a same reference symbol, and redundant description thereof will be omitted.

Figure 17:
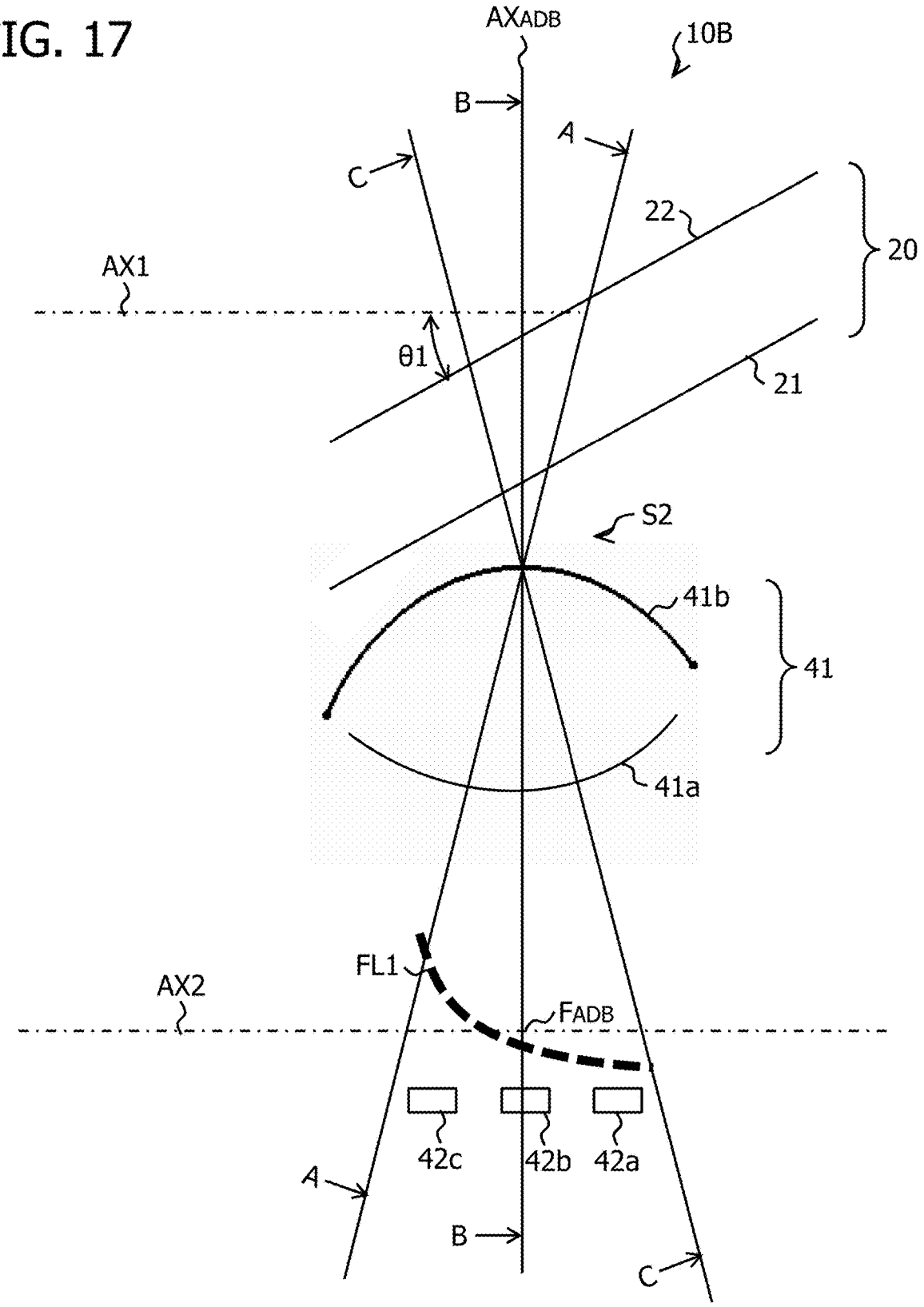
FIG. 17 is a top view of the vehicular lamp fitting 10B (portions other than the major optical surface are omitted)
Figure 18:
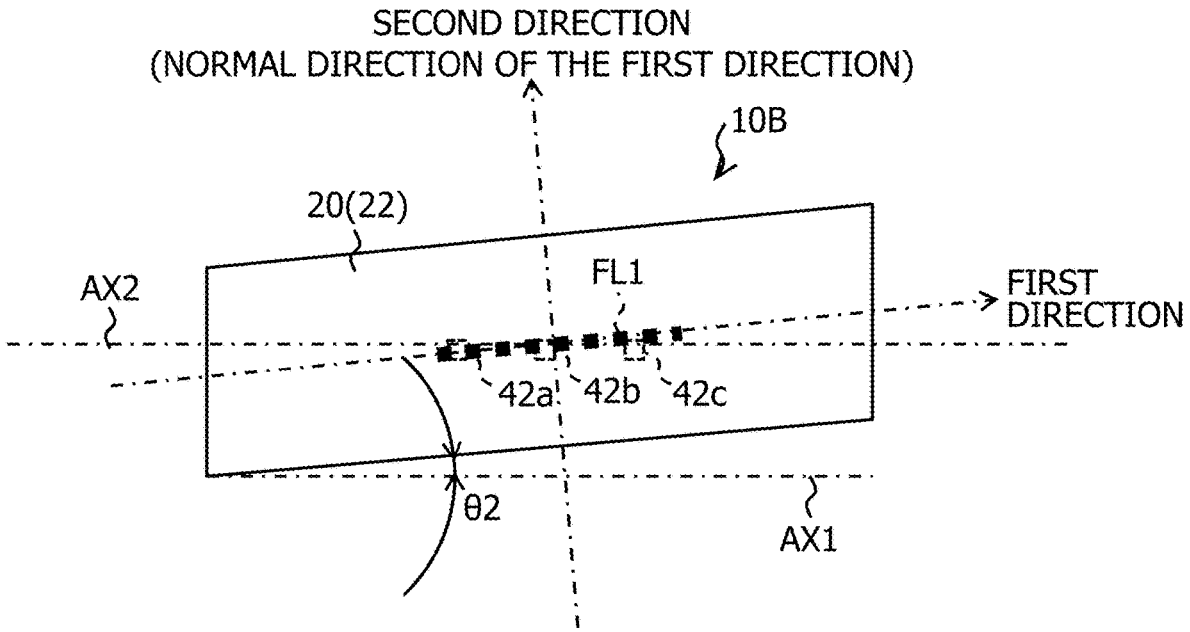
FIG. 18 is a front view of the vehicular lamp fitting 10B.

FIG. 17 is a top view of the vehicular lamp fitting 10B (portions other than the major optical surface are omitted). FIG. 18 is a front view of the vehicular lamp fitting 10B.

The vehicular lamp fitting 10B shown in FIGS. 1 to 2 is a vehicular headlamp (headlamp) that can form a ADB light distribution pattern and is mounted to, for example, the left and right sides on the front end of a vehicle such as an automobile. Because the vehicular lamp fitting 10B to be mounted to both the left and right sides has a symmetrical configuration, a vehicular lamp fitting 10B mounted to the left side at the front of a vehicle (left side facing the front of the vehicle) is described as a representative example of the vehicular lamp fitting 10B. Although not illustrated, the vehicular lamp fitting 10B is arranged in a lamp chamber constituted by an outer lens and a housing and is attached to the housing or the like.

As illustrated in FIG. 17 and FIG. 18, the vehicular lamp fitting 10B includes: a front lens body 20; a rear lens unit 41 disposed behind the front lens body 20; and a plurality of light sources 42*a* to 42*c*, that are disposed behind the rear lens units 41, and that emit respective light which passes through the rear lens units 41 and the front lens body 20 in this order, and is irradiated forward, so as to form a ADB light distribution pattern.

The front lens body 20 and the rear lens unit 41 are made of transparent resin such as acrylic and polycarbonate. The front lens body 20 and the rear lens unit 41 are separately molded in a physically separated state by injection molding. The front lens body 20 and the rear lens unit 41 are configured as a lens body connected by a holding member (not shown) such as a lens holder.

The front lens body 20 is a lens unit extending in a predetermined direction (also referred to as a first direction herein). The first direction is, for example, a direction inclined, with respect to a reference axis AX1 which extends in the vehicle width direction, at a receding angle θ1 when viewed from the top, as illustrated in FIG. 17, and also is a direction inclined, with respect to the reference axis AX1, at a upward angle θ2 when viewed from the front, as illustrated in FIG. 18. The angles θ1 is any angles from between 0° to 90°. The angle θ2 is any angle that is greater than 0 and less than 90°. To simplify description, an example where θ1 is 30° and θ2 is 5° will be described.

In a general vehicular lamp, one projection lens is responsible for condensing light in the first direction and light in the second direction orthogonal to the first direction. In contrast, in this embodiment, two lenses (the front lens body 20 and the rear lens unit 41) which make up a projection lens are responsible for condensing light in the first direction and light in the second direction orthogonal to the first direction. More specifically, in this embodiment, the rear lens unit 41 is mainly responsible for condensing light in the first direction and the front lens body 20 is mainly responsible for condensing light in the second direction.

Figure 19A:
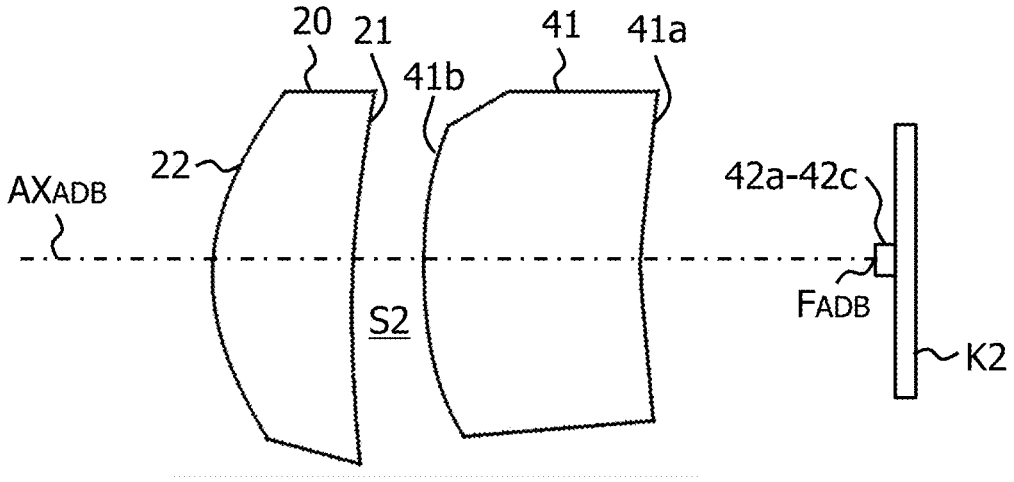
FIG. 19A is an B-B cross-sectional view of the vehicular lamp fitting 10B illustrated in FIG. 17.

FIG. 19A is an B-B cross-sectional view of the vehicular lamp fitting 10B illustrated in FIG. 17. In FIG. 17, FIG. 19A and the like, the line extending in the vehicle length direction, indicated by the reference symbol $AX_{ADB}$, is an optical axis of a projection lens which is configured by the front lens body 20 and the rear lens unit 41. This optical axis is hereafter referred to as the optical axis $AX_{ADB}$.

As illustrated in FIG. 19A, the front lens body 20 includes a second entry surface 21 and a second exit surface 22 disposed on the opposite side of the second entry surface 21. The front lens body 20 is mainly responsible for condensing light from the rear lens unit 41 transmitting the front lens body 20 in the second direction. The second entry surface 21 and the second exit surface 22 extend in the first direction (e.g. see FIG. 18) respectively.

In concrete terms, as illustrated in FIG. 19A, the second entry surface 21 is configured as a cylindrical surface that is convex in the forward direction and of which cylindrical axis extends in the first direction. The second exit surface 22 is configured as a cylindrical surface that is convex in the forward direction and of which cylindrical axis extends in the first direction. The curvature (curvature of a cross-section orthogonal to the first direction) of the second entry surface 21 is the same in each cross-section. The curvature (curvature of a cross-section orthogonal to the first direction) of the second exit surface 22 is the same in each cross-section. The second entry surface 21 and the second exit surface 22 may be a plane or a planar surface.

Figure 19B:
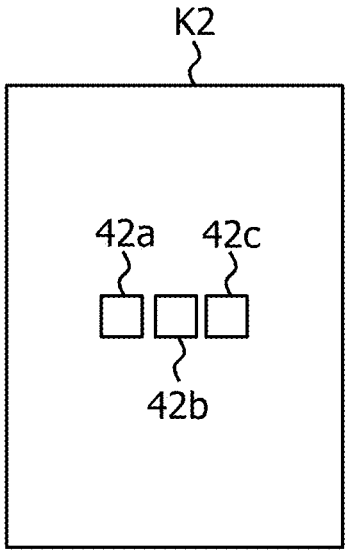
FIG. 19B is a front view of the substrate K2.

FIG. 19B is a front view of the substrate K2 on which the light sources 42*a* to 42*c* are mounted.

As illustrated in FIG. 19B, the light source 42*a* to 42*c* are semiconductor light emitting element such as an LED or LD having a rectangular (for example, a 1 $mm^2$) light emitting surface and are mounted to a substrate K2 with the light emitting surface facing forward (to the front). The light sources 42*a* to 42*c* are arranged in a line in the horizontal direction in the vicinity of the focal point $F_{ADB}$ of the projection lens configured by the front lens body 20 and the rear lens unit 41. The substrate K2 is mounted to the housing (not shown) using a screw or another means.

The focal point $F_{ADB}$ is a condensed point on the optical axis $AX_{ADB}$ condensed behind the rear lens unit 41, when the horizontal ray group, which is parallel with the optical axis $AX_{ADB}$, enters the rear lens unit 41 through the front lens body 20 from the front side of the front lens body 20.

As illustrated in FIG. 19A, the rear lens unit 41 includes a first entry surface 41*a*, and a first exit surface 41*b* on the side opposite to the first entry surface 41*a*. The rear lens unit 41 is mainly responsible for condensing the light from the light sources 42*a* to 42*c* passing through the rear lens unit 41 in the first direction.

The first entry surface 41*a* is a surface through which the light coming from the light sources 42*a* to 42*c* enters the rear lens unit 41. The lateral section of the first entry surface 41*a*, illustrated in FIG. 17, is configured basically as a curved surface that is convex in the backward direction, but the shape of each lateral section is not the same, and the cross-sectional shape of the lateral section is different in each lateral section. The longitudinal section of the first entry surface 41*a*, illustrated in FIG. 19A, is configured basically as a curved surface that is convex in the forward direction, but the shape of each longitudinal section is not the same, and the cross-sectional shape of the longitudinal section is different in each longitudinal section. A concrete surface shape of the first entry surface 41*a* will be described later.

The first exit surface 41*b* is a surface through which the respective light coming from the light sources 42*a* to 42*c*, which entered the rear lens unit 41 through the first entry surface 41*a*, exits. The first exit surface 41*b* is configured as a curved surface convex toward the front. The curvature of the longitudinal cross section and the curvature of the cross section of the first exit surface 41*b* are, for example, the same in each longitudinal cross section and each cross section.

In the vehicular lamp fitting 10B having the above-described configuration, when the light sources 42*a* to 42*c* are turned on, the light from the light sources 42*a* to 42*c* enters the rear lens units 41 from the first entry surface 41*a* and exits from the first exit surface 41*b*. At this time, the first exit surface 41*b* (lateral section of the first exit surface 41*b*) acts to condense, in the first direction, the light from the light source 42*a* to 42*c* which exits the first exit surface 41*b*. Then, the light from the light source 42*a* to 42*c* which has exited the first exit surface 41*b* passes through a space S2 between the rear lens unit 41 and the front lens body 20, further enters the front lens body 20 from the second entry surface 21 and is irradiated forward after exiting the second exit surface 22. At this time, the second exit surface 22 acts to condense, in the second direction, the light from the light source 42*a* to 42*c* which exit the second exit surface 22. Thereby, the ADB light distribution pattern is formed.

In other words, the light source images of the light sources 42*a* to 42*c* are inverted and projected forward by the rear lens unit 41 and the front lens body 20, which function as the projection lens. Thereby the ADB light distribution pattern is formed.

Next an ADB light distribution pattern, that is formed when the front lens body 20 is disposed in an attitude that is inclined at a predetermined upward angle θ2, as illustrated in FIG. 18, will be described.

Figure 20A:
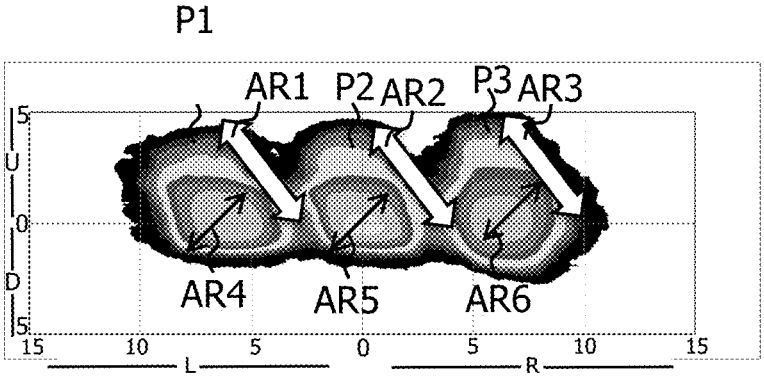
FIG. 20A indicates an example of the ADB light distribution pattern that is formed when the front lens body 20 is disposed in an attitude that is inclined at a predetermined upward angle θ2.

FIG. 20A indicates an example of the ADB light distribution pattern that is formed on a virtual vertical screen facing the front surface of the vehicle (disposed at 25 m in the forward direction from the front surface of the vehicle), when the front lens body 20 is disposed in an attitude that is inclined at a predetermined upward angle θ2.

As illustrated in FIG. 20A, the ADB light distribution pattern includes a plurality of irradiation regions P1 to P3 which are horizontally disposed on a line in the high beam region. The irradiation regions P1 to P3 are independently turned ON/OFF (including lighting in the dimmed state) in accordance with the turning ON/OFF of the light sources 42*a* to 42*c* (including lighting in the dimmed state). FIG. 20A indicates an example of the ADB light distribution pattern which is formed in the state that the light sources 42*a* to 42*c* are lit (fully lit) respectively.

The present inventors performed simulation and confirmed that the ADB light distribution pattern is stretched in the arrow marks AR1 to AR3 directions, and is formed in a state of being diagonally deformed (diagonal blur state), when the front lens body 20 is disposed in an attitude that is inclined by the upward angle θ2, as illustrated in FIG. 20A.

This is because in the case of disposing the front lens body 20 in an attitude that is inclined by the upward angle θ2, the extending direction, of a focal line FL1 of the projection lens constituted by the front lens body 20 and the rear lens unit 41, becomes a first direction when viewed from the front, as illustrated in FIG. 18, which does not match with the direction in which the light sources 42*a* to 42*c* are disposed (horizontal direction).

In other words, in the case of disposing the front lens body 20 in an attitude that is inclined by the upward angle θ2, the extending direction of the focal line FL1 does not match with the direction in which the light sources 42*a* to 42*c* are disposed (horizontal direction), therefore the light source images of the light sources 42*a* to 42*c* are condensed in the normal direction of the first direction by the front lens body 20 (see FIG. 18), and the light in each of the irradiation regions P1 to P3 is condensed in the arrow marks AR4 to AR6 directions in FIG. 20A respectively. As a result, the ADB light distribution pattern is stretched in the arrow marks AR1 to AR3 directions, and is formed in a state of being diagonally deformed (diagonal blur state).

The focal line FL1 (the same applies to the below-mentioned focal lines FL2 and FL3.) is a group of condensed points which are formed behind the rear lens unit 41, when a plurality of horizontal rays, which are included in a plurality of vertical surfaces having mutually different inclination angles with respect to the optical axis $AX_{ADB}$ respectively, passes through the front lens body 20 and the rear lens unit 41 from the front side of the front lens body 20.

Figure 21:
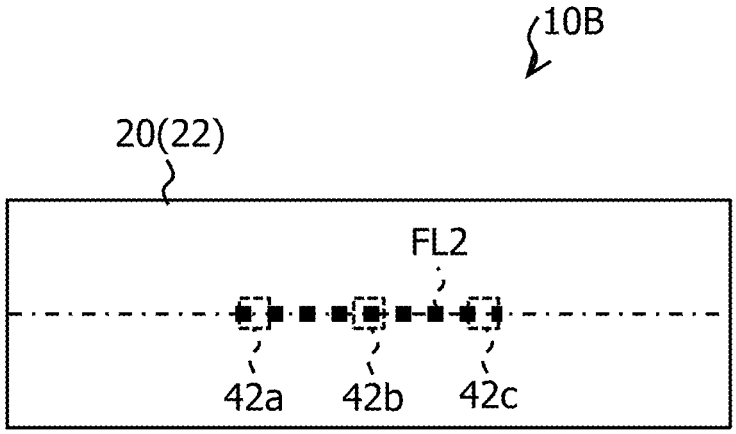
FIG. 21 is a front view of the vehicular lamp fitting 10B (when the front lens body 20 is disposed in an attitude that is not inclined by the upward angle θ2)

Next an ADB light distribution pattern that is formed when the front lens body 20 is disposed in an attitude that is not inclined by the upward angle θ2, as illustrated in FIG. 21, will be described. FIG. 21 is a front view of the vehicular lamp fitting 10B (when the front lens body 20 is disposed in an attitude that is not inclined by the upward angle θ2).

Figure 20B:
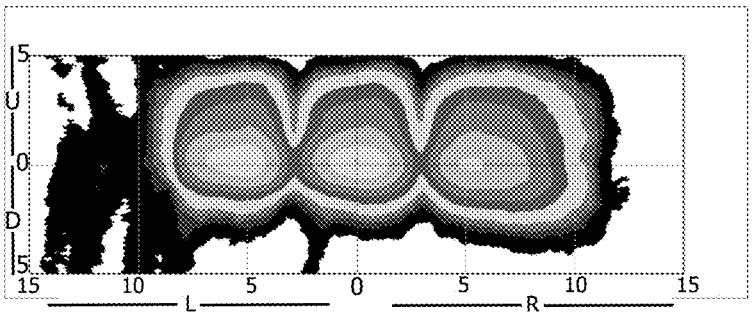
FIG. 20B is an example of the ADB light distribution pattern which is formed when the front lens body 20 is disposed in an attitude that is not inclined by the upward angle θ2.

FIG. 20B is an example of the ADB light distribution pattern which is formed when the front lens body 20 is disposed in an attitude that is not inclined by the upward angle θ2. FIG. 20B indicates an example of the ADB light distribution pattern which is formed on a virtual vertical screen facing the front surface of the vehicle.

In the case of disposing the front lens body 20 in an attitude that is not inclined by the upward angle θ2, the ADB light distribution pattern is not formed in the state of being diagonally deformed (diagonal blur state), but is appropriately formed in the state where the light source images of the light sources 42*a* to 42*c* are inversely projected, as illustrated in FIG. 20B, just like the case of using a common projection lens.

This is because in the case of disposing the front lens body 20 in an attitude that is not inclined by the upward angle θ2, the extending direction of a focal line FL2 of the projection lens constituted by the front lens body 20 and the rear lens unit 41, matches with the direction in which the light sources 42*a* to 42*c* are disposed (horizontal direction) when viewed from the front, as illustrated in FIG. 21.

As illustrated in FIG. 20A, a configuration for suppressing that the ADB light distribution pattern is formed in a state of being diagonally deformed (diagonal blur state) will be described next.

As a result of intensive studies to suppress formation of the ADB light distribution pattern in an obliquely deformed state, the present inventors discovered that the formation of the ADB light distribution pattern in an obliquely deformed state can be suppressed by adjusting the curvature of the first entry surface 41*a* in the longitudinal section for each longitudinal section.

This adjustment is an adjustment for correcting the focal lines FL1 shown in FIG. 18 into focal lines (e.g. focal lines FL2 shown in FIG. 21) extending in the horizontal direction (the vehicle width direction). This adjustment is performed using a predetermined simulation software.

An example of adjusting the surface shape of the first entry surface 41*a* will be described next with reference to FIG. 17.

In FIG. 1, the cross-sectional shape of the first entry surface 41*a* in the A-A cross-section is adjusted (set) so that when the horizontal ray group included in the A-A cross-section passes through the front lens body 20 and the rear lens unit 41, the horizontal ray group is condensed and forms a condensed point behind the rear lens unit 41 and in the vicinity of a reference axis AX2 (see FIG. 17 and FIG. 18) when viewed from the front. As illustrated in FIG. 17, the reference axis AX2 is a horizontal line orthogonal to the optical axis $AX_{ADB}$, and passes through the focal point $F_{ADB}$.

In the same manner, each cross-sectional shape (not shown) of a plurality of longitudinal sections (a plurality of longitudinal sections having mutually different inclination angles with respect to the optical axis $AX_{ADB}$) between the A-A cross-section and the B-B cross-section as well, is adjusted (set) so that when the horizontal ray group included in each of the plurality of longitudinal sections passes through the front lens body 20 and the rear lens unit 41, the horizontal ray group is condensed and forms a condensed point behind the rear lens unit 41 and in the vicinity of the reference axis AX2 (see FIG. 18) when viewed from the front.

In FIG. 17, the cross-sectional shape of the first entry surface 41*a* in the B-B cross-section is adjusted (set) so that when the horizontal ray group included in the B-B cross-section passes through the front lens body 20 and the rear lens unit 41, the horizontal ray group is condensed and forms a condensed point behind the rear lens unit 41 and in the vicinity of a reference axis AX2 (see FIG. 18) when viewed from the front.

In FIG. 17, the cross-sectional shape of the first entry surface 41*a* in the C-C cross-section is adjusted (set) so that when the horizontal ray group included in the C-C cross-section passes through the front lens body 20 and the rear lens unit 41, the horizontal ray group is condensed and forms a condensed point behind the rear lens unit 41 and in the vicinity of a reference axis AX2 (see FIG. 18) when viewed from the front.

In the same manner, each cross-sectional shape (not shown) of a plurality of longitudinal sections (a plurality of longitudinal sections having mutually different inclination angles with respect to the optical axis $AX_{ADB}$) between the B-B cross-section and the C-C cross-section as well, is adjusted (set) so that when the horizontal ray group included in each of the plurality of longitudinal sections passes through the front lens body 20 and the rear lens unit 41, the horizontal ray group is condensed and forms a condensed point behind the rear lens unit 41 and in the vicinity of the reference axis AX2 (see FIG. 18) when viewed from the front.

Figure 22:
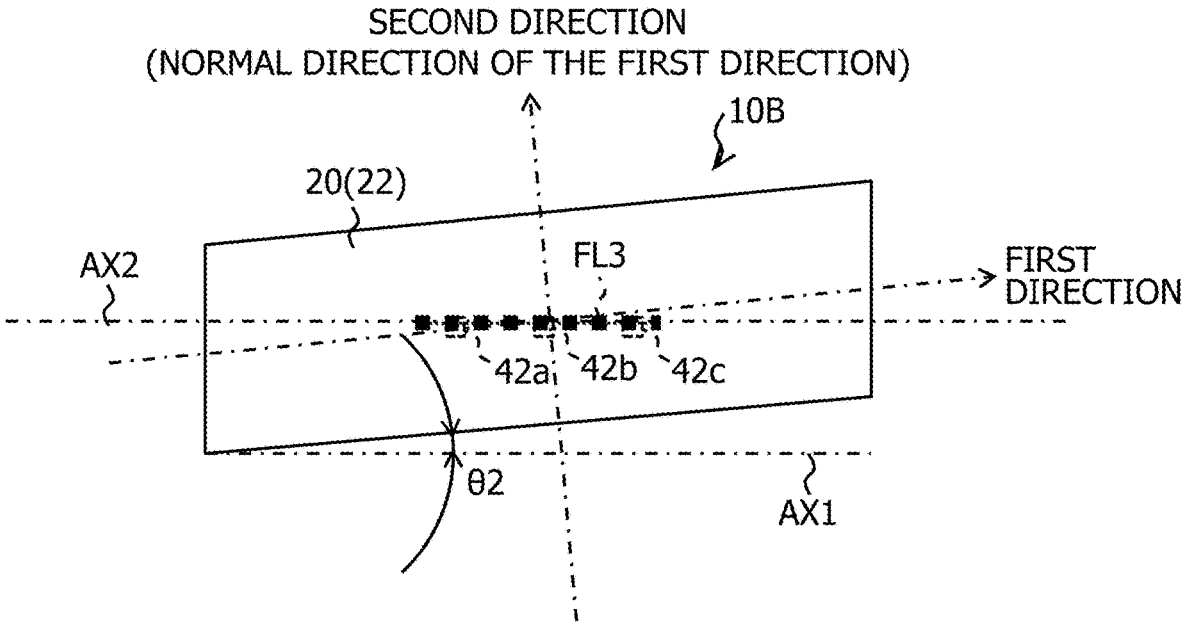
FIG. 22 is a front view of the vehicular lamp fitting 10B.

By adjusting the surface shape of the first entry surface 41*a* as described above, the condensed point group that is formed as above constitutes a focal line F3 which extends in a direction matching (or approximately matching) with the direction in which the light sources 42*a* to 42*c* are disposed (horizontal direction) when viewed from the front, even if the front lens body 20 is disposed in an attitude that is inclined by the upward angle θ2, as illustrated in FIG. 22. FIG. 22 is a front view of the vehicular lamp fitting 10B.

In other words, by adjusting the surface shape of the first entry surface 41*a* as above, the positional relationship between the focal line FL3 and the light sources 42*a* to 42*c* when viewed from the front becomes the same as the positional relationship between the focal line FL2 and the light sources 42*a* to 42*c* when viewed from the front, as illustrated in FIG. 21.

As a result, the ADB light distribution pattern is not formed in a state of being diagonally deformed (diagonal blur state) even if the front lens body 20 is disposed in an attitude that is inclined by the upward angle θ2, and the ADB light distribution pattern is appropriately formed in the state where the light source images of the light sources 42*a* to 42*c* are inversely projected, just like the case of FIG. 20B. In other words, the generation of the ADB light distribution pattern in the state of being diagonally deformed is suppressed.

The first entry surface 41*a* (surface shape), which is formed by adjusting the surface shape of the first entry surface 41*a* as above, will be described next.

Figure 23A:
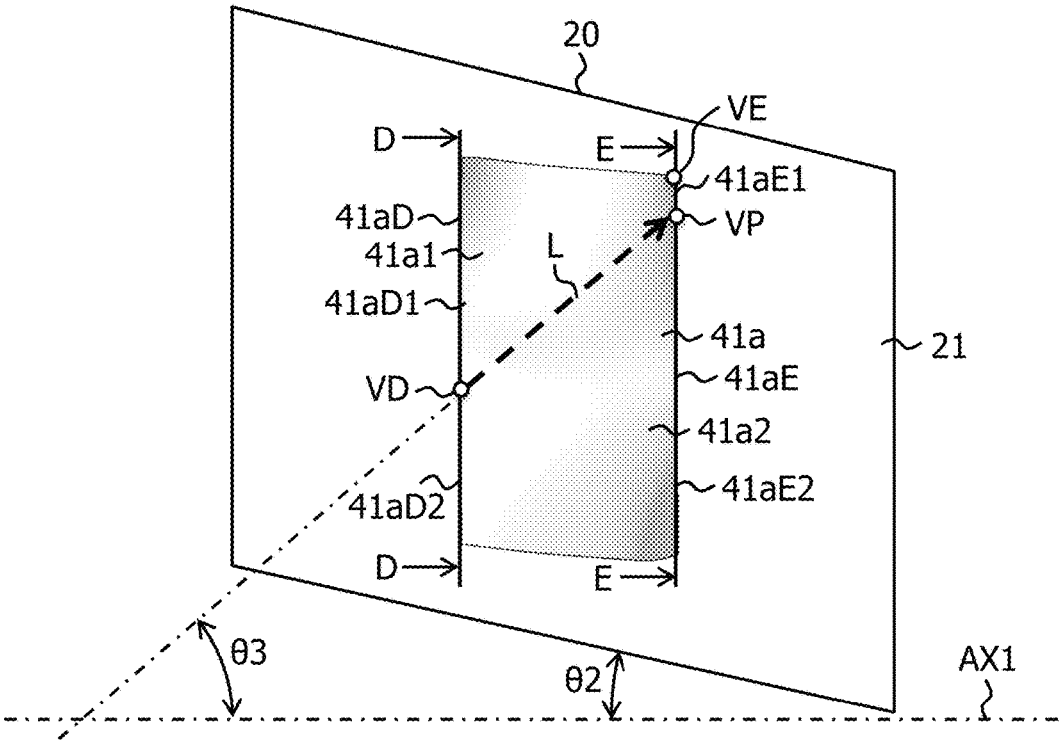
FIG. 23A is a rear view of the rear lens unit 41 (front view of the first entry surface 41*a*)
Figure 23B:
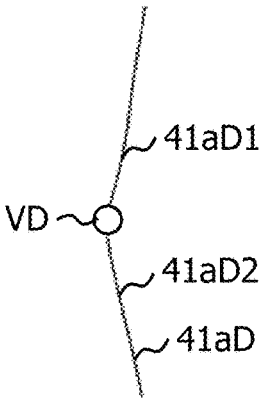
FIG. 23B is a D-D sectional view of the first entry surface 41*a* in FIG. 7A.
Figure 23C:
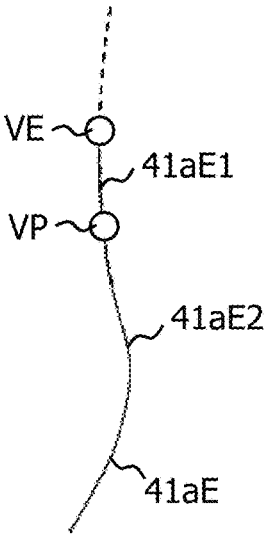
FIG. 23C is an E-E sectional view of the first entry surface 41*a* in FIG. 23A.
Figure 24:
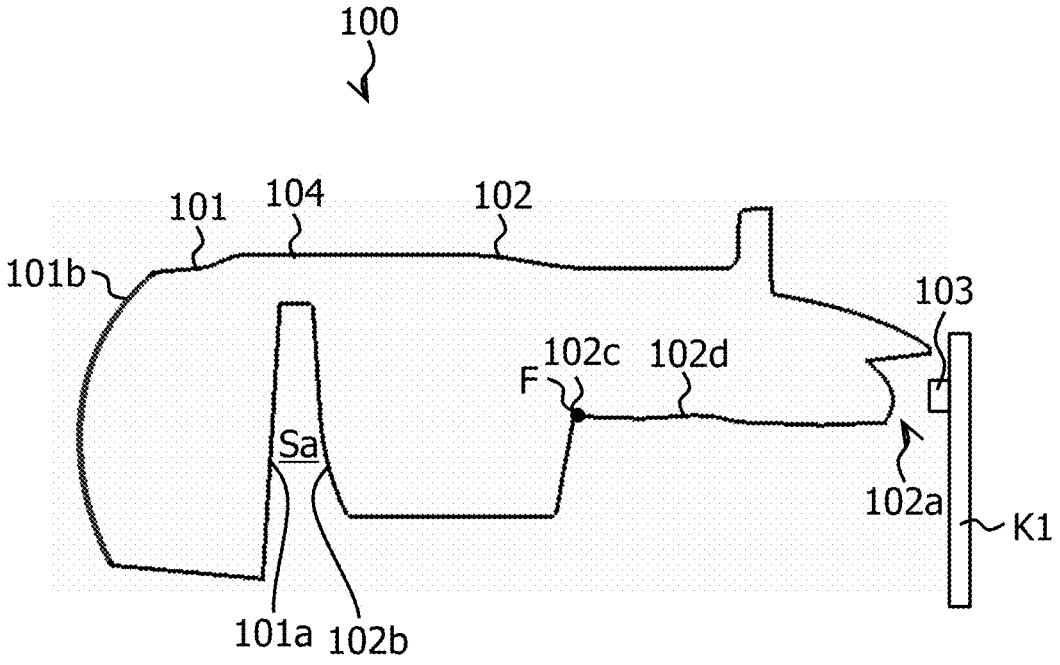
FIG. 24 is a longitudinal sectional view of a conventional vehicular lamp fitting 100.
Figure 25:
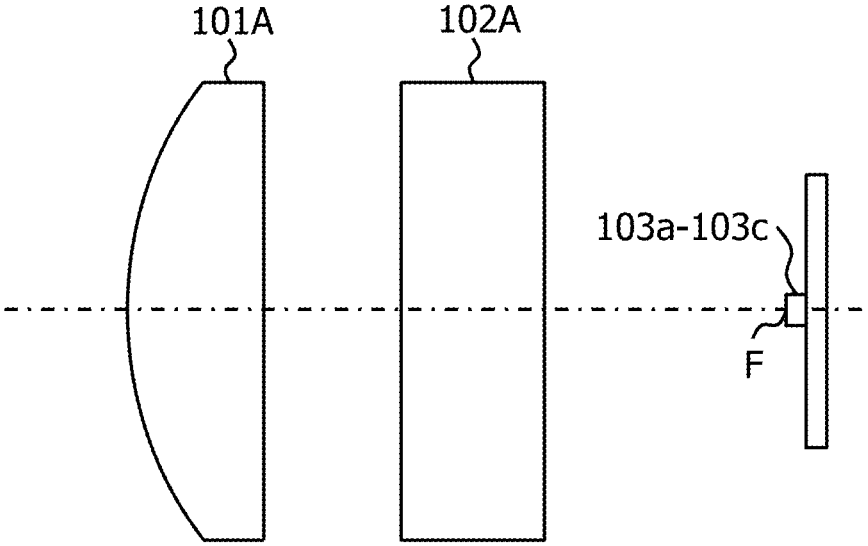
FIG. 25 is an example of disposing a plurality of light sources 103*a* to 103*c* in the vicinity of a focal point F of a projection lens constituted of a front lens body 101A and a rear lens unit 102A.
Figure 26:
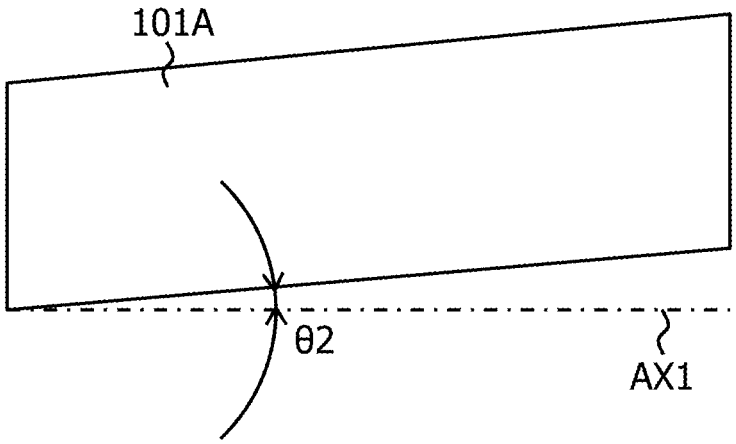
FIG. 26 is a front view of the front lens body 101A illustrated in FIG. 25.

FIG. 23A is a rear view of the rear lens unit 41 (front view of the first entry surface 41*a*). FIG. 23B is a D-D sectional view of the first entry surface 41*a* in FIG. 7A, and FIG. 23C is an E-E sectional view of the first entry surface 41*a* in FIG. 23A.

The longitudinal section of the first entry surface 41*a* includes a first longitudinal section and a second longitudinal section which is distant from the first longitudinal section in the horizontal direction (vehicle width direction) by a predetermined distance.

The first longitudinal section is a D-D cross-section of the first entry surface 41*a*, as illustrated in FIG. 23B, and includes a first curve 41*a*D constituted by: a first vertex VD; a first partial curve 41*a*D1 which extends linearly from the first vertex VD diagonally upward in the backward direction; and a second partial curve 41*a*D2 which extends linearly from the first vertex VD diagonally downward in the backward direction.

The second longitudinal section includes, as illustrated in FIG. 23B, a second curve 41*a*E constituted by: a second vertex VE; an inflection point VP; a third partial curve 41*a*E1 which extends upward from the inflection point VP, and is slightly convex in the forward direction, and a fourth partial curve 41*a*E2 which extends downward from the inflection point VP, and is slightly convex in the backward direction.

The first entry surface 41*a* is a curved surface between the first curve 41*a*D and the second curve 41*a*E, that is, a curved surface (e.g. freeform surface) configured such that the surface shape gradually becomes smoother with no step in the direction from the first curve 41*a*D to the second curve 41*a*E, and as illustrated in FIG. 7A, the first entry surface 41*a* includes: a convex portion L which extends linearly between the first vertex VD and the inflection point VP, and is convex in the forward direction; an upper surface 41*a*1 which is disposed on the upper side of the linearly extending convex portion L; and a lower surface 41*a*2 which is disposed on the lower side thereof.

The convex portion L extends linearly in a direction that is inclined with respect to the reference axis AX1 at a predetermined angle θ3 in the opposite direction of the upward angle θ2 when viewed from the back (see FIG. 23A).

The upper surface 41*a*1 is a curved surface between the first partial curve 41*a*D1 and the third partial curve 41*a*E1, that is, a curved surface (e.g. freeform surface) configured such that the surface shape gradually becomes smoother with no step in the direction from the first partial curve 41*a*D1 to the third partial curve 41*a*E1.

The lower surface 41*a*2 is a curved surface between the second partial curve 41*a*D2 and the forth partial curve 41*a*E2, that is, a curved surface (e.g. freeform surface) configured such that the surface shape gradually becomes smoother with no step in the direction from the second partial curve 41*a*D2 to the forth partial curve 41*a*E2.

As described above, according to this embodiment, a vehicular lamp fitting 10B, which suppresses the generation of the ADB light distribution pattern in the state of being diagonally deformed (diagonal blur state), can be provided, even if the front lens body 20 is disposed in an attitude that is inclined at a predetermined upward angle θ2 as shown in FIG. 18.

This is because the surface shape of the first entry surface 41*a* is adjusted so that the focal line F3 of the projection lens formed by the front lens body 20 and the rear lens unit 41 becomes a focal line extending in the horizontal direction (vehicle width direction) (See FIG. 22).

In concrete terms, the surface shape of the first exit surface 31*b* is adjusted (set) so that when the horizontal ray group, which is included in each of the plurality of longitudinal sections (vertical surfaces) having mutually different inclination angles with respect to the optical axis $AX_{ADB}$, passes through the front lens body 20 and the rear lens unit 41, the horizontal ray group is condensed and forms the focal line FL3 (condensed point group) along the reference axis AX2 (along the direction in which the light sources 42*a* to 42*c* are disposed) behind the rear lens unit 41 and in the vicinity of the reference axis AX2 (see FIG. 18) when viewed from the front.

A modification will be described next.

In this embodiment, an example of suppressing the generation of the ADB light distribution pattern in the state of being diagonally deformed (diagonal blur state) was described by adjusting the surface shape of the first entry surface 41*a*, but the present invention is not limited to this.

For example, the generation of the ADB light distribution pattern in the state of being diagonally deformed (diagonal blur state) may be suppressed by adjusting the surface shape of at least one of the first entry surface 41*a*, the first exit surface 41*b* and the second entry surface 21. The surface shape of the first exit surface 41*b* and the surface shape of the second entry surface 21 can also be adjusted in the same manner as the adjustment of the surface shape of the first entry surface 41*a*.

It goes without saying that the numbers in the above-described embodiment are merely examples and other appropriate numbers may be used.

The various aspects of the above-described embodiment are merely exemplary and the description of the embodiment is not intended to limit the scope of the present invention. The present invention may be implemented in numerous other ways without departing from the gist or main technical characteristics of the present invention.

The invention claimed is:

1. A vehicular lamp fitting comprising:

a front lens body;

a rear lens unit disposed behind the front lens body; and a light source that is disposed behind the rear lens unit, and that emits light, which passes through the rear lens unit and the front lens body in this order and is irradiated forward, so as to form a low beam light distribution pattern, wherein the rear lens unit is a lens unit configured to condense, at least in a first direction, the light coming from the light source and passing through the rear lens unit, and includes: a first entry surface through which the light coming from the light source enters the rear lens unit; a first exit surface through which the light coming from the light source, which entered the rear lens unit, exits; and an edge which defines a cut-off line of the low beam light distribution pattern, the front lens body is a lens unit configured to condense, in a second direction intersecting the first direction, the light coming from the rear lens unit and passing through the front lens body, and includes: a second entry surface through which the light coming from the rear lens unit enters the front lens body; and a second exit surface through which the light coming from the rear lens unit, which entered the front lens body, exits, the front lens body is a linearly extending semicircular column-shaped lens and is disposed in an attitude in which a cylindrical axis of the front lens body is inclined at a predetermined receding angle with respect to a reference axis extending in a vehicle width direction, at least one of the first exit surface of the rear lens unit and a second entry surface of the front lens body is configured so that light rays entering the front lens body in a direction towards the rear lens unit and that passes through the second exit surface of the front lens body, the second entry surface of the front lens body and the first exit surface of the rear lens unit in this order from a front side of the front lens body, are condensed, and form a focal line along the reference axis extending in the vehicle width direction inside the rear lens unit, and the edge is disposed along the focal line.

2. The vehicular lamp fitting according to claim 1, wherein a configuration of the first exit surface of the rear lens unit and a second entry surface of the front lens body is accomplished using a predetermined simulation software, and light that passes through the second exit surface, the second entry surface and the first exit surface in this order is a group of horizontal rays that is included in a plurality of vertical planes each having a different inclination angle with respect to a reference axis extending in the longitudinal direction of the vehicle, and is parallel to the reference axis extending in the longitudinal direction of the vehicle.

3. The vehicular lamp fitting according to claim 2, wherein configuration of the first exit surface of the rear lens unit and a second entry surface of the front lens body includes a change of curvature of each portion where the first exit surface and the plurality of vertical planes intersect and/or change of curvature of each portion where the second entry surface and the plurality of vertical planes intersect, for each portion.

4. The vehicular lamp fitting according to claim 3, the curvature of each of the first exit surface and the second entry surface is changed so as to become larger as the distance between the first exit surface and the second entry surface through which a ray passing through the first exit surface and the second entry surface is shorter.

5. A vehicular lamp fitting comprising:

a front lens body;

a rear lens unit disposed behind the front lens body; and a light source that is disposed behind the rear lens unit, and that emits light, which passes through the rear lens unit and the front lens body in this order and is irradiated forward, so as to form a predetermined light distribution pattern, wherein the rear lens unit is a lens unit configured to condense, at least in a first direction, the light coming from the light source and passing through the rear lens unit, and includes: a first entry surface through which the light coming from the light source enters the rear lens unit; a first exit surface through which the light coming from the light source, which entered the rear lens unit, exits, the front lens body is a linearly extending semicircular column-shaped lens and is disposed in an attitude in which a cylindrical axis of the front lens body is inclined at a predetermined receding angle with respect to a reference axis extending in a vehicle width direction, and at least one of the first exit surface of the rear lens unit and a second entry surface of the front lens body is configured so that light that passes through a second exit surface of the front lens body, the second entry surface of the front lens body and the first exit surface of the rear lens unit in this order from a front side of the front lens body, is condensed, and forms a focal line along the reference axis extending in the vehicle width direction.

* * * * *